US008879366B2

(12) United States Patent
Dierenbach

(10) Patent No.: US 8,879,366 B2
(45) Date of Patent: Nov. 4, 2014

(54) CLOCKS WITH UNIQUELY DRIVEN ELEMENTS WHICH ARE INTERPRETED BY THE USE OF TRADITIONAL CLOCK INTERPRETATION METHODS

(71) Applicant: Karl Allen Dierenbach, Centennial, CO (US)

(72) Inventor: Karl Allen Dierenbach, Centennial, CO (US)

( * ) Notice: Subject to any disclaimer, the term of this patent is extended or adjusted under 35 U.S.C. 154(b) by 31 days.

(21) Appl. No.: 13/790,858

(22) Filed: Mar. 8, 2013

(65) Prior Publication Data

US 2014/0086024 A1 Mar. 27, 2014

Related U.S. Application Data

(60) Provisional application No. 61/610,129, filed on Mar. 13, 2012, provisional application No. 61/649,518, filed on May 21, 2012.

(51) Int. Cl.

| | |
|---|---|
| ***G04B 19/20*** | (2006.01) |
| ***G04B 19/04*** | (2006.01) |
| ***G04B 19/02*** | (2006.01) |

(52) U.S. Cl.

CPC ..... *G04B 19/02* (2013.01); *G04B 19/046* (2013.01)

USPC ..... 368/221; 368/223; 368/77; 368/220

(58) Field of Classification Search

USPC ..... 368/76, 77, 80, 220, 221, 223; 40/111–115

See application file for complete search history.

(56) References Cited

U.S. PATENT DOCUMENTS

| | | | | |
|---|---|---|---|---|
| 1,475,800 | A | 11/1923 | Creasy | |
| 2,153,004 | A | 4/1939 | Rodanet | |
| 2,466,312 | A | 4/1949 | Heintz | |
| 2,886,942 | A | 5/1959 | Stucky | |
| 3,668,858 | A | 6/1972 | Hartwig | |
| 3,890,777 | A | 6/1975 | Stanish | |
| 3,934,405 | A | 1/1976 | Baker | |
| 4,428,682 | A | 1/1984 | Winter | |
| 4,726,000 | A | 2/1988 | Weiss | |
| 5,349,572 | A | 9/1994 | Belik | |
| 5,359,578 | A | 10/1994 | Truini | |
| 5,602,803 | A | 2/1997 | Chaut | |
| 5,671,194 | A * | 9/1997 | Chaut | 368/223 |
| 5,751,663 | A | 5/1998 | Johnson | |
| 5,844,864 | A * | 12/1998 | Chaut | 368/223 |
| 5,999,496 | A | 12/1999 | Chaut | |
| 6,819,632 | B1 * | 11/2004 | Paul | 368/88 |
| 7,061,833 | B2 | 6/2006 | Dierenbach | |
| 2010/0091616 | A1 * | 4/2010 | Bonhoff | 368/80 |

* cited by examiner

*Primary Examiner* — Amy Cohen Johnson
*Assistant Examiner* — Jason Collins

(57) ABSTRACT

Apparatuses (250) for the display of time with distinctive aesthetic character that include rigid rotating members (220) which are driven by movements (251) and held in place by the force of gravity. The movement (251) rotates drive wheels (256, 257) so that the rigid rotating members (220) indicate the current time and the time is interpreted using traditional clock interpretation methods. The movement (251) may include a support bushing (260) to provide support for output shafts (252, 253) of the movement (251). A cover (262) may also provide support for output shafts (252, 253).

17 Claims, 20 Drawing Sheets

*Section A-A*

*Section B-B*

*Section C-C*

FIG. 21
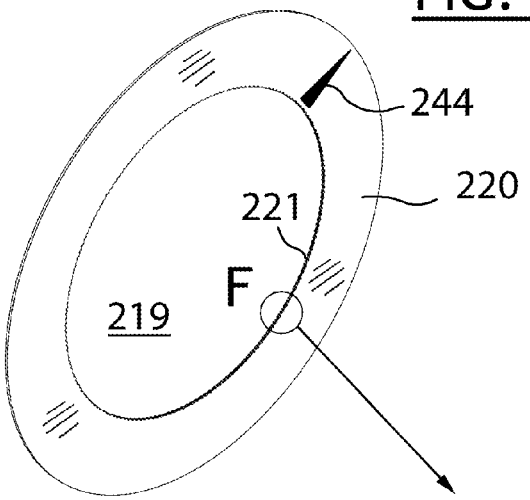
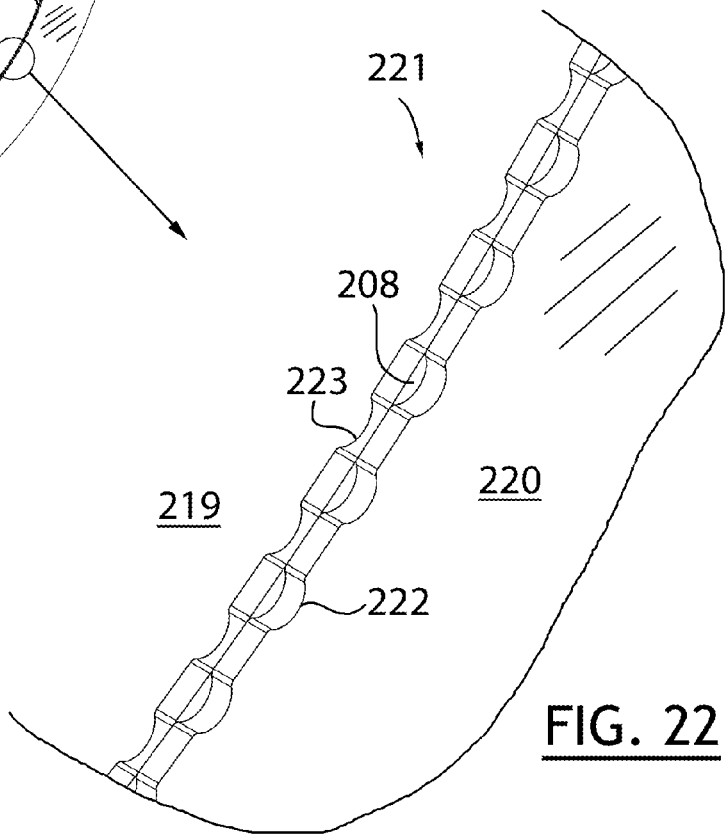
FIG. 22

FIG. 28
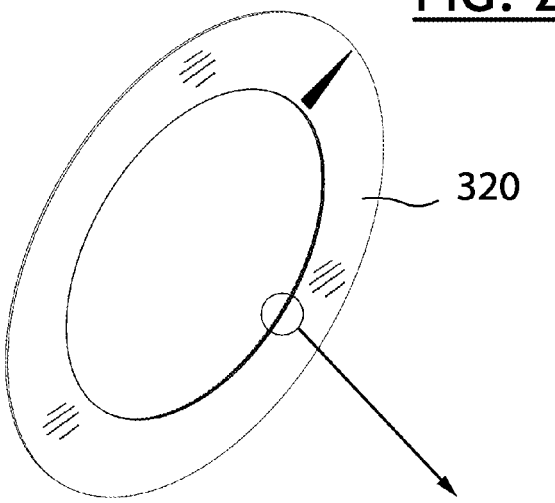
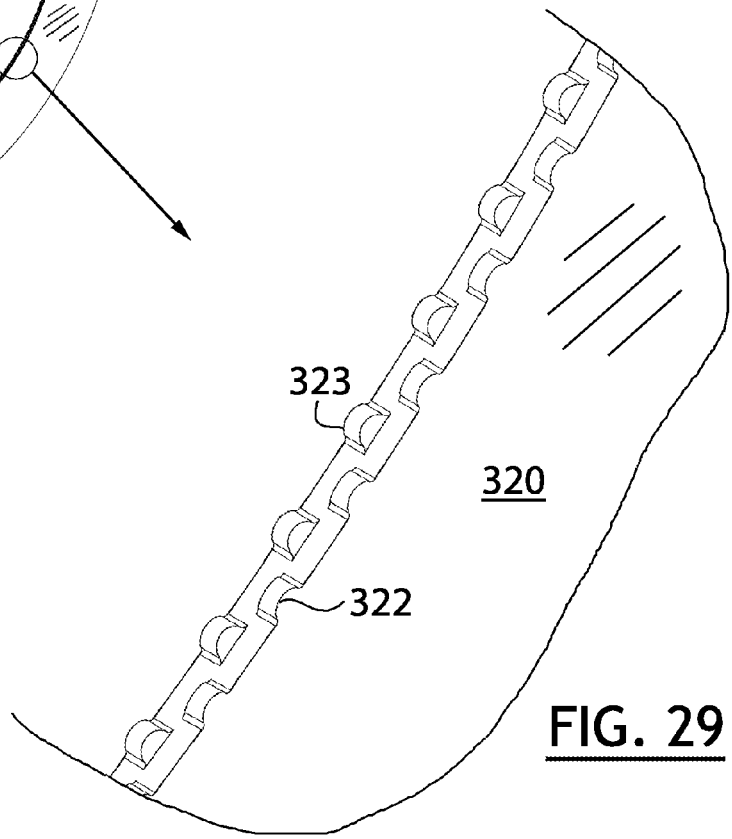
FIG. 29

CLOCKS WITH UNIQUELY DRIVEN ELEMENTS WHICH ARE INTERPRETED BY THE USE OF TRADITIONAL CLOCK INTERPRETATION METHODS

RELATED APPLICATIONS

This application claims the benefit of U.S. Provisional Application No. 61/610,129, filed Mar. 13, 2012, entitled "CLOCKS WITH PERIMETER DRIVEN ELEMENTS WHICH ARE INTERPRETED BY THE USE OF TRADITIONAL CLOCK INTERPRETATION METHODS," and this application claims the benefit of U.S. Provisional Application No. 61/649,518, filed May 21, 2012, entitled "CLOCKS WITH UNIQUELY DRIVEN ELEMENTS WHICH ARE INTERPRETED BY THE USE OF TRADITIONAL CLOCK INTERPRETATION METHODS," both of which are incorporated herein by reference in their entirety.

FIELD OF THE INVENTION

The present invention relates to clocks, specifically to clocks with uniquely driven elements where the clocks are interpreted through traditional clock interpretation methods.

BACKGROUND OF THE INVENTION

For centuries man has designed and built clocks that served the dual purpose of indicating the current time and adding to the aesthetic decor of an area.

Traditionally, mechanical clocks, whether driven by weights, springs and/or electrical energy, have consisted of a clock face and a number of hands rotating about a central point on the clock face. The hour hand is typically shorter and completes one revolution every twelve hours. The minute hand is typically larger and completes one revolution every sixty minutes. To aid in the user's interpretation of the device, the clock face often features time demarcations. This configuration is ubiquitous and is popular in architectural clocks, wall clocks, desk clocks, and wrist watches.

Many clock designers, such as in U.S. Pat. No. 2,153,004, by C. H. H. Rodanet, issued Apr. 4, 1939, seek to achieve aesthetic distinction by altering the symbols used on the clock face and/or by designing uniquely shaped hands. That clock also attached the hands onto rotating disks to give the appearance that the hands were floating.

Other clock designers, such as in U.S. Pat. No. 5,999,496, by Y. Chaut, issued Dec. 7, 1999, seek to achieve aesthetic appeal through a unique configuration of elements that do not feature hands or traditional clock faces. While such clocks may be considered aesthetically striking, these clocks do not allow the use of traditional clock interpretation methods to determine the indicated time.

The present inventor previously patented a group of aesthetically appealing clocks which used traditional clock interpretation methods to determine the indicated time in U.S. Pat. No. 7,061,833, by Karl Allen Dierenbach, issued Jun. 13, 2006. However, there remains a need for, and it would be advantageous to have, additional clocks that are aesthetically unique and do not possess traditional faces or hands, but nonetheless are interpreted using traditional clock interpretation methods.

SUMMARY OF THE INVENTION

The present invention is directed toward clocks with unique designs which are easily read using traditional clock interpretation methods and structure associated with such designs.

"Traditional clock interpretation methods" refers to the traditional way the current time is interpreted by observing the positions of a minute hand and an hour hand on a typical clock. Thus, a clock with two non-identical indicators moving through a circular path about a common point, where one of the indicators is rotating at a rate of one revolution per hour and the other indicator is rotating at a rate of one revolution every twelve hours, may be interpreted by using traditional clock interpretation methods.

In a first aspect, a clock movement including a case, a battery compartment, a motor, a gear train, a mounting bushing, an inner output shaft, an outer output shaft, and a support bushing is described. The battery compartment may be configured to interconnect to a battery. The motor may be disposed within the case. The mounting bushing may be an elongated tubular member with a proximal end and a distal end, and the proximal end may be fixed to the case. The inner output shaft may be driven at a first angular rate by the motor. The outer output shaft may be driven at a second angular rate by the motor. The first angular rate may be different than the second angular rate. The inner shaft and the outer shaft may be coaxial. The inner shaft may be disposed within the outer shaft. The outer shaft and the mounting bushing may be coaxial. The outer shaft may be disposed within the mounting bushing. The support bushing may be fixed to the distal end of the mounting bushing. A bearing portion of the support bushing may be positioned distal to the mounting bushing. The bearing portion of the support bushing may include an annular bearing surface surrounding a bearing portion of the outer output shaft. The movement may be configured such that no portion of the clock movement is disposed between the annular bearing surface and the bearing portion of the outer output shaft.

In an arrangement, the support bushing may comprise a polymer. The polymer, for example, may be polyoxymethylene and/or polytetrafluoroethylene.

In an arrangement, the mounting bushing may comprise external threads and the support bushing may comprise corresponding internal threads. The support bushing may comprise a nut disposed within a polymer portion, and the corresponding internal threads may be on the nut. The nut may comprise a metal such as, for example, brass.

In an arrangement, the mounting bushing may comprise external threads and the support bushing may be pressed onto the external threads such that the support bushing is fixedly interconnected to the mounting bushing.

In an arrangement, the support bushing may be a unitary member.

In an arrangement, the clock movement may be configured such that a load applied perpendicular to the outer output shaft at a distal end of the outer output shaft causes the outer output shaft to be pressed against the annular bearing surface.

In an arrangement, the clock movement may be configured such that a load applied perpendicular to the inner output shaft at a distal end of the inner output shaft causes the outer output shaft to be pressed against the annular bearing surface.

In another aspect, a clock is disclosed that comprises a clock movement, first and second drive wheels, and first and second rigid members. The clock movement may be the clock movement described in the first aspect. The clock movement may include first and second output shafts driven at different angular rates, and the first and second output shafts may be coaxial.

The first drive wheel may be fixed to the first output shaft, and the second drive wheel may be fixed to the second output shaft. The first rigid member may be a ring and include a first inner annular surface (e.g., a circular surface defined by a through hole through the first rigid member). The first rigid member may be suspended by the first drive wheel. The first rigid member may include an hour demarcation to represent the hour. The first inner annular surface of the first rigid member with hour demarcation may be in contact with the first drive wheel such that when the first drive wheel is rotated, the first rigid member with hour demarcation is rotated at a different angular rate than the first drive wheel so that the first rigid member rotates through one complete revolution once every twelve hours allowing the hour to be interpreted using traditional clock interpretation means. In this regard, the first drive wheel may be positioned within an area defined by the first inner annular surface. The first rigid member may be held in contact with the first drive wheel by the force of gravity.

The second rigid member may be a ring and include a second inner annular surface. The second rigid member may be suspended by the second drive wheel. The second rigid member may comprise a minute demarcation to represent the minute of the hour. The second inner annular surface of the second rigid member with minute demarcation may be in contact with the second drive wheel so as to rotate the second rigid member with minute demarcation at a different angular rate than the second drive wheel so that the second rigid member rotates through one complete revolution once every hour allowing the minute of the hour to be interpreted using traditional clock interpretation means. In this regard, the second drive wheel may be positioned within an area defined by the second inner annular surface. The second rigid member may be held in contact with the second drive wheel by the force of gravity. The second rigid member may rotate about substantially the same rotational axis as the first rigid member.

The first drive wheel may comprise a first plurality of protrusions disposed about a perimeter of the first drive wheel. The first rigid member may comprise a first plurality of indentations disposed along the first inner annular surface. The first plurality of protrusions may be configured to mesh with the first plurality of indentations as the first drive wheel rotates.

The second drive wheel may comprise a second plurality of protrusions disposed about a perimeter of the second drive wheel. The second rigid member may comprise a second plurality of indentations disposed along the second inner annular surface. The second plurality of protrusions may be configured to mesh with the second plurality of indentations as the second drive wheel rotates.

In an arrangement, each protrusion of the first plurality of protrusions may be of a first radius, and each indentation of the first plurality of indentations may be of a second radius, and the second radius may be larger than the first radius.

In an arrangement of the current aspect, each protrusion of the first and second pluralities of protrusions may be of a first radius, and each indentation of the first and second pluralities of indentations may be of a second radius, and the second radius may be larger than the first radius.

In an arrangement, each protrusion and indentation may be configured such that any misalignment between a protrusion and corresponding indentation at a top dead center position that is greater than zero and less than a radius of the indentation may cause the protrusion to move relative to the indentation and toward alignment with the indentation due to the force of gravity.

In an arrangement, a diameter of the first inner annular surface may be the same as a diameter of the second inner annular surface.

In an arrangement, the locations of the indentations and protrusions may be reversed such that the protrusions are disposed on the inner annular surfaces and the indentations are disposed on the perimeters of the drive wheels.

In another aspect, a clock is disclosed that comprises a clock movement, first and second drive wheels, first and second rigid members, and first and second drive belts. The clock movement may comprise first and second output shafts driven at different angular rates. The first and second output shafts may be coaxial. The first drive wheel may be fixed to the first output shaft, and the second drive wheel may be fixed to the second output shaft. The first rigid member may comprise a first outer annular surface. The first rigid member may comprise an hour demarcation to represent the hour. The second rigid member may comprise a second outer annular surface. The second rigid member may comprise a minute demarcation to represent the minute of the hour.

The first drive belt may be partially disposed about a portion of a perimeter of the first drive wheel and partially disposed about a portion of the first outer annular surface. The first rigid member may be suspended from the first drive wheel by the first drive belt. The first drive belt may be kept in contact with the first drive wheel by the force of gravity. The first rigid member may be kept in contact with the first drive belt by the force of gravity. The first drive wheel may be in contact with the first belt in such a manner so as to move the first drive belt as the first drive wheel is rotated. The first belt may be in contact with the first rigid member in such a manner so as to rotate the first rigid member as the first drive wheel is rotated. The first rigid member may be rotated at a rate so that the first rigid member rotates through one complete revolution once every twelve hours allowing the hour to be interpreted using traditional clock interpretation means.

The second drive belt may be partially disposed about a portion of a perimeter of the second drive wheel and partially disposed about a portion of the second outer annular surface. The second rigid member may be suspended from the second drive wheel by the second drive belt. The second drive belt may be kept in contact with the second drive wheel by the force of gravity. The second rigid member may be kept in contact with the second drive belt by the force of gravity. The second drive wheel may be in contact with the second belt in such a manner so as to move the second drive belt as the second drive wheel is rotated. The second belt may be in contact with the second rigid member in such a manner so as to rotate the second rigid member as the second drive wheel is rotated. The second rigid member may be rotated at a rate so that the second rigid member rotates through one complete revolution once every hour allowing the minute of the hour to be interpreted using traditional clock interpretation means. The second rigid member may rotate about substantially the same rotational axis as the first rigid member.

In an arrangement, the first and second drive belts may be toothed belts, and the first and second rigid members and the first and second drive wheels may each comprise teeth corresponding to the toothed first and second drive belts.

In an arrangement, the first belt, the first rigid member, and the first drive wheel may be configured such that the first rigid member rotates at a different rate than the first drive wheel when the first drive wheel is rotated (e.g., the first rigid member may have a larger diameter than the first drive wheel). Similarly, the second belt, the second rigid member, and the second drive wheel may be configured such that the second rigid member rotates at a different rate than the second drive wheel when the second drive wheel is rotated. In an alternative arrangement, the first belt, the first rigid member, and the first drive wheel may be configured such that the first rigid member rotates at the same rate as the first drive wheel when the first drive wheel is rotated (e.g., the first rigid member may have the same diameter as the first drive wheel); and the second belt, the second rigid member, and the second drive wheel may be configured such that the second rigid member rotates at the same rate as the second drive wheel when the second drive wheel is rotated.

In an arrangement, the diameter of the first outer annular surface may be the same as the diameter of the second outer annular surface.

In an arrangement, the second rigid member may be an annular ring with an innermost radius and an outermost radius, and the innermost radius of the second rigid member may be at least ten percent as large as the outermost radius of the second rigid member. In another arrangement, the innermost radius of the second rigid member may be at least fifty percent as large as the outermost radius of the second rigid member.

In an arrangement, the first rigid member may be an annular ring with an innermost radius and an outermost radius, and the innermost radius of the first rigid member may be at least ten percent as large as the outermost radius of the first rigid member. In another arrangement, the innermost radius of the first rigid member may be at least fifty percent as large as the outermost radius of the first rigid member.

In an arrangement, the first rigid member may be a disk. Such a disk may have no holes through its center.

In an arrangement, the first and second rigid members may be disks, and the second rigid member may be transparent. Thus, the first rigid member may be visible through the second rigid member.

In another aspect, a clock is disclosed that comprises a clock movement, first and second drive wheels, first and second rigid rings, first through fourth pluralities of protrusions, and first through fourth pluralities of indentations.

The clock movement comprises first and second coaxial output shafts driven at different angular rates. The first and second output shafts are disposed along an axis of rotation. The first drive wheel is fixed to the first output shaft and the second drive wheel is fixed to the second output shaft.

The first rigid ring has a first inner annular surface which is suspended by the first drive wheel. The first rigid ring comprises an hour demarcation to represent the hour of the day. The first inner annular surface of the first rigid ring is in contact with the first drive wheel so as to rotate the first rigid ring at a different angular rate than the first drive wheel so that the first rigid ring rotates through one complete revolution once every twelve hours allowing the hour of the day to be interpreted using traditional clock interpretation means. The first rigid ring is held in contact with the first drive wheel by the force of gravity.

The second rigid ring has a second inner annular surface which is suspended by the second drive wheel. The second rigid ring comprises a minute demarcation to represent the minute of the hour. The second inner annular surface of the second rigid ring with minute demarcation is in contact with the second drive wheel so as to rotate the second rigid ring with minute demarcation at a different angular rate than the second drive wheel so that the second rigid ring rotates through one complete revolution once every hour allowing the minute of the hour to be interpreted using traditional clock interpretation means. The second rigid ring is held in contact with the second drive wheel by the force of gravity. The second rigid ring rotates about substantially the same rotational axis as the first rigid ring.

The first plurality of protrusions is disposed about a perimeter of the first drive wheel. Each protrusion of the first plurality of protrusions is disposed within a first plane that is perpendicular to the axis of rotation. The second plurality of protrusions is also disposed about the perimeter of the first drive wheel. Each protrusion of the second plurality of protrusions is disposed within a second plane that is perpendicular to the axis of rotation. The first plane is offset from the second plane. The first plurality of protrusions is circumferentially offset from the second plurality of protrusions such that as the first drive wheel rotates about the axis of rotation, individual protrusions from the first and second pluralities of protrusions alternately occupy a top dead center position.

The first plurality of indentations is disposed along the first inner annular surface within the first plane when the first rigid ring is suspended by the first drive wheel. The first plurality of indentations meshes with the first plurality of protrusions as the first drive wheel rotates.

The second plurality of indentations is disposed along the first inner annular surface within the second plane when the first rigid ring is suspended by the first drive wheel. The second plurality of indentations meshes with the second plurality of protrusions as the first drive wheel rotates.

The third plurality of protrusions is disposed about a perimeter of the second drive wheel. Each protrusion of the third plurality of protrusions is disposed within a third plane that is perpendicular to the axis of rotation. The fourth plurality of protrusions is also disposed about the perimeter of the second drive wheel. Each protrusion of the fourth plurality of protrusions is disposed within a fourth plane that is perpendicular to the axis of rotation. The third plane is offset from the fourth plane. The third plurality of protrusions is circumferentially offset from the fourth plurality of protrusions such that as the second drive wheel rotates about the axis of rotation, individual protrusions from the third and fourth pluralities of protrusions alternately occupy a top dead center position.

The third plurality of indentations is disposed along the second inner annular surface within the third plane when the second rigid ring is suspended by the second drive wheel. The third plurality of indentations meshes with the third plurality of protrusions as the second drive wheel rotates.

The fourth plurality of indentations is disposed along the second inner annular surface within the fourth plane when the second rigid ring is suspended by the second drive wheel. The fourth plurality of indentations meshes with the fourth plurality of protrusions as the second drive wheel rotates.

In an arrangement of the current aspect, each protrusion of the first plurality of protrusions may be of a first radius, and each indentation of the first plurality of indentations may be of a second radius, and the second radius may be larger than the first radius. In such an arrangement, the first radius may be between 0.015 and 0.040 inches, and the second radius may be between 0.025 and 0.050 inches.

In an embodiment, each protrusion of the first, second, third, and fourth pluralities of protrusions may be of a first radius, and each indentation of the first, second, third, and fourth pluralities of indentations may be of a second radius, and the second radius may be larger than the first radius.

In an arrangement, each protrusion and indentation may be configured such that any misalignment between a protrusion and indentation at a top dead center position that is greater than zero and less than a radius of the indentation will cause the protrusion to move toward alignment with the indentation due to the force of gravity.

In an arrangement, the diameter of the first inner annular surface may be the same as a diameter of the second inner annular surface.

In an arrangement, the positions of the indentations and protrusions may be reversed such that the indentations are on the drive wheels and the protrusions are on the rigid rings.

In another aspect, a clock is disclosed that comprises a clock movement, first and second drive wheels, a cover, a first rigid ring and a second rigid ring.

The clock movement comprises first and second coaxial output shafts driven at different angular rates. The first and second output shafts are disposed along an axis of rotation.

The first drive wheel is fixed to the first output shaft. The first drive wheel comprises first and second flanges disposed along a perimeter of the first drive wheel on opposing sides of the first drive wheel. The outer edges of the first and second flanges are a first distance apart from each other. The second drive wheel is fixed to the second output shaft. The second drive wheel comprises third and fourth flanges disposed along a perimeter of the second drive wheel on opposing sides of the second drive wheel. The outer edges of the third and fourth flanges are a second distance apart from each other.

The cover covers the clock movement, the first and second output shafts, and the first and second drive wheels. The cover comprises a first slot aligned with the first drive wheel and a second slot aligned with the second drive wheel. The width of the first slot is less than the first distance and the width of second slot is less than the second distance.

The first rigid ring comprises a first inner annular surface which is suspended by the first drive wheel. The first rigid ring includes an hour demarcation to represent the hour. The first inner annular surface is in contact with the first drive wheel so as to rotate the first rigid ring at a different angular rate than the first drive wheel so that the first rigid ring rotates through one complete revolution once every twelve hours allowing the hour of the day to be interpreted using traditional clock interpretation means. The first rigid ring is held in contact with the first drive wheel by the force of gravity. The thickness of the first rigid ring is less than the width of the first slot. A portion of the first rigid ring is disposed within the first slot, and a portion of the first rigid ring is disposed between the first and second flanges.

The second rigid ring comprises a second inner annular surface which is suspended by the second drive wheel. The second rigid ring includes a minute demarcation to represent the minute of the hour. The second inner annular surface is in contact with the second drive wheel so as to rotate the second rigid ring at a different angular rate than the second drive wheel so that the second rigid ring rotates through one complete revolution once every hour allowing the minute of the hour to be interpreted using traditional clock interpretation means. The second rigid ring is held in contact with the second drive wheel by the force of gravity. The thickness of the second rigid ring is less than the width of the second slot. A portion of the second rigid ring is disposed within the second slot, and a portion of the second rigid ring is disposed between the third and fourth flanges. The second rigid ring rotates about substantially the same rotational axis as the first rigid ring.

An embodiment of the current aspect may comprise the first through fourth pluralities of protrusions and the corresponding first through fourth pluralities of indentations discussed with respect to the previous aspect.

In another aspect, a method of assembling a clock is disclosed. The method comprises fixing an hour indicator drive wheel to an hour output shaft of a clock movement, then fixing a minute indicator drive wheel to a minute output shaft of the clock movement. The method also includes fixing the clock movement to a cover that comprises an hour ring clearance slot and a minute ring clearance slot. After the drive wheels are fixed and the cover is attached, the next step is positioning an hour indicator ring within the hour ring clearance slot such that the hour indicator ring rests on the hour indicator drive wheel and such that an hour indicator disposed on the hour indicator ring is properly positioned to indicate the current hour of the day using traditional clock interpretation methods. This is followed by positioning a minute indicator ring within the minute ring clearance slot such that the minute indicator ring rests on the minute indicator drive wheel and such that a minute indicator disposed on the minute indicator ring is properly positioned to indicate the current minute of the hour using traditional clock interpretation methods.

In an embodiment of the current aspect, the method may further include fixing the clock movement to a mounting plate prior to fixing the hour indicator drive wheel to the hour output shaft. In a variation, prior to fixing the hour indicator drive wheel to the hour output shaft and after the fixing the clock movement to the mounting plate, the method may include fixing a support bushing to a distal end of a mounting bushing of the clock movement. Such a support bushing when fixed may provide a support surface for the hour output shaft of the clock movement.

In an embodiment, the cover may comprise a first portion and a second portion, wherein fixing the clock movement to the cover further comprises attaching the mounting plate to the first portion, then attaching the second portion to the first portion.

In an embodiment, the method may include fixing the clock movement and the cover to a support structure.

In another aspect, another method of assembling a clock is disclosed. The method comprises fixing a support bushing to a distal end of a mounting bushing of a clock movement such that the support bushing as fixed provides a support surface for an hour output shaft of the movement, then fixing an hour indicator drive wheel to the hour output shaft of the clock movement, and then fixing a minute indicator drive wheel to a minute output shaft of the clock movement. Next, the method further includes positioning an hour indicator ring such that the hour indicator ring rests on the hour indicator drive wheel and such that an hour indicator disposed on the hour indicator ring is properly positioned to indicate the current hour of the day using traditional clock interpretation methods. Next, the method further includes positioning a minute indicator ring such that the minute indicator ring rests on the minute indicator drive wheel and such that a minute indicator disposed on the minute indicator ring is properly positioned to indicate the current minute of the hour using traditional clock interpretation methods.

In another aspect, a method of indicating the current time is disclosed. The method comprises driving an hour indicator drive wheel at a first rotational rate about a first axis, and driving, by the hour indicator drive wheel, an hour indicator ring at a second rotational rate about a second axis. The first rotational rate is greater than the second rotational rate, and the second rotational rate is one revolution every twelve hours. The first axis is offset from the second axis. The method further includes maintaining contact between an outer annular surface of the hour indicator drive wheel and an inner annular surface of the hour indicator ring by the force of gravity acting upon the hour indicator ring. The hour indicator drive wheel is disposed within a central through hole of the hour indicator ring. The method further includes indicating the current hour of the day using traditional clock interpretation methods by the position of an hour indicator affixed to the hour indicator ring. The method further includes maintaining synchronization between the hour indicator drive wheel and the hour indicator ring by sequentially engaging a plurality of protrusions disposed along the outer annular surface of the hour indicator drive wheel with a plurality of indentations disposed along the inner annular surface of the hour indicator ring.

The method further includes driving a minute indicator drive wheel at a third rotational rate about the first axis, and driving, by the minute indicator drive wheel, a minute indicator ring at a fourth rotational rate about the second axis. The third rotational rate is greater than the fourth rotational rate, and the fourth rotational rate is one revolution every hour. The method further includes maintaining contact between an outer annular surface of the minute indicator drive wheel and an inner annular surface of the minute indicator ring by the force of gravity acting upon the minute indicator ring. The minute indicator drive wheel is disposed within a central through hole of the minute indicator ring. The method further includes indicating the current minute of the hour using traditional clock interpretation methods by the position of a minute indicator affixed to the minute indicator ring. The method further includes maintaining synchronization between the minute indicator drive wheel and the minute indicator ring by sequentially engaging a plurality of protrusions disposed along the outer annular surface of the minute indicator drive wheel with a plurality of indentations disposed along the inner annular surface of the minute indicator ring.

In an arrangement of the current method, the step of maintaining synchronization between the hour indicator drive wheel and the hour indicator ring may comprise engaging a first plurality of protrusions disposed along the outer annular surface of the hour indicator drive wheel with a first plurality of indentations disposed along the inner annular surface of the hour indicator ring, and engaging a second plurality of protrusions disposed along the outer annular surface of the hour indicator drive wheel with a second plurality of indentations disposed along the inner annular surface of the hour indicator ring. The first plurality of protrusions may be disposed within a first plane and the second plurality of protrusions may be disposed within a second plane, and the first plane may be offset from the second plane. Moreover, during performance of the method, only one protrusion-indentation engagement combination occupies a top dead center position at any single point in time.

In another aspect, a clock is disclosed that comprises a clock movement, a support bushing, a first drive wheel, a second drive wheel, a cover, a first rigid ring, and a second rigid ring.

The clock movement comprises first and second output shafts driven at different angular rates. The first and second output shafts are coaxial. The first and second output shafts are disposed along an axis of rotation. The clock movement comprises a mounting bushing. The mounting bushing is an elongated tubular member. The mounting bushing comprises a proximal end and a distal end. The proximal end of the mounting bushing is fixed to a case of the clock movement. The second output shaft is at least partially disposed within the first output shaft.

The support bushing is fixed to the distal end of the mounting bushing. A bearing portion of the support bushing is positioned distal to the mounting bushing. The bearing portion of the support bushing includes an annular bearing surface surrounding a bearing portion of the first output shaft. No portion of the clock movement is disposed between the annular bearing surface and the bearing portion of the first output shaft.

The first drive wheel is fixed to the first output shaft. The second drive wheel is fixed to the second output shaft. The second drive wheel comprises a shaft portion disposed along the axis of rotation and distal to a distal end of the second output shaft.

The clock movement, the first and second output shafts, and the first and second drive wheels are disposed within the cover. The cover comprises a first slot aligned with the first drive wheel. The cover comprises a second slot aligned with the second drive wheel. The cover comprises a hole. The shaft portion of the second drive wheel is at least partially disposed within the hole. The hole comprises a bearing portion in contact with the shaft portion. The first and second drive wheels are disposed between the support bushing and the hole.

The first rigid ring comprises a first inner annular surface which is suspended by the first drive wheel. The first rigid ring comprises an hour demarcation to represent the hour. The first inner annular surface of the first rigid ring is in contact with the first drive wheel so as to rotate the first rigid ring at a different angular rate than the first drive wheel so that the first rigid ring rotates through one complete revolution once every twelve hours allowing the hour of the day to be interpreted using traditional clock interpretation means. The first rigid ring is held in contact with the first drive wheel by the force of gravity. A portion of the first rigid ring is disposed within the first slot.

The second rigid ring comprises a second inner annular surface which is suspended by the second drive wheel. The second rigid ring comprises a minute demarcation to represent the minute of the hour. The second inner annular surface of the second rigid ring is in contact with the second drive wheel so as to rotate the second rigid ring at a different angular rate than the second drive wheel so that the second rigid ring rotates through one complete revolution once every hour allowing the minute of the hour to be interpreted using traditional clock interpretation means. The second rigid ring is held in contact with the second drive wheel by the force of gravity. A thickness of the second rigid ring is less than the width of the second slot. A portion of the second rigid ring is disposed within the second slot. The second rigid ring rotates about substantially the same rotational axis as the first rigid ring.

In a variation of the current aspect, the support bushing may not be present. In such an arrangement, the combination of the hole and shaft portion may provide the only support to the first and second output shafts that is external to the clock movement.

In another aspect, a clock is disclosed that includes a clock movement, first and second drive wheels, a cover, a first rigid ring, and a second rigid.

The clock movement comprises a case, a battery compartment configured to interconnect to a battery, a motor disposed within the case, a gear train, a mounting bushing, an inner output shaft, an outer output shaft, and a support bushing. The mounting bushing is an elongated tubular member. The mounting bushing comprises a proximal end and a distal end. The proximal end of the mounting bushing is fixed to the case. The inner output shaft is driven at a first angular rate by the motor. The outer output shaft is driven at a second angular rate by the motor. The first angular rate is different than the second angular rate. The inner shaft and the outer shaft are coaxial. The inner shaft is at least partially disposed within the outer shaft. The outer shaft and the mounting bushing are coaxial along an axis of rotation. The outer shaft is at least partially disposed within the mounting bushing. The support bushing is fixed relative to the distal end of the mounting bushing. A bearing portion of the support bushing is positioned distal to the mounting bushing. The bearing portion of the support bushing includes an annular bearing surface surrounding a bearing portion of the outer output shaft. No portion of the clock movement is disposed between the annular bearing surface and the bearing portion of the outer output shaft.

The first drive wheel is fixed to the outer output shaft and the second drive wheel is fixed to the inner output shaft. The second drive wheel comprises a shaft portion disposed along the axis of rotation and distal to a distal end of the inner output shaft.

The clock movement and the first and second drive wheels are disposed within the cover. The cover comprises a first slot aligned with the first drive wheel. The cover comprises a second slot aligned with the second drive wheel. The cover comprises a hole. The shaft portion of the second drive wheel is at least partially disposed within the hole. The hole comprises a bearing portion in contact with the shaft portion. The first and second drive wheels are disposed between the support bushing and the hole.

The first rigid ring comprises a first inner annular surface which is suspended by the first drive wheel. The first rigid ring comprises an hour demarcation to represent the hour. The first inner annular surface of the first rigid ring is in contact with the first drive wheel so as to rotate the first rigid ring at a different angular rate than the first drive wheel so that the first rigid ring rotates through one complete revolution once every twelve hours allowing the hour of the day to be interpreted using traditional clock interpretation means. The first rigid ring is held in contact with the first drive wheel by the force of gravity. A portion of the first rigid ring is disposed within the first slot. The first rigid ring rotates about a rigid ring axis. The rigid ring axis is not coaxial with the axis of rotation.

The second rigid ring comprises a second inner annular surface which is suspended by the second drive wheel. The second rigid ring comprises a minute demarcation to represent the minute of the hour. The second inner annular surface of the second rigid ring is in contact with the second drive wheel so as to rotate the second rigid ring at a different angular rate than the second drive wheel so that the second rigid ring rotates through one complete revolution once every hour allowing the minute of the hour to be interpreted using traditional clock interpretation means. The second rigid ring is held in contact with the second drive wheel by the force of gravity. A thickness of the second rigid ring is less than the width of the second slot. A portion of the second rigid ring is disposed within the second slot. The second rigid ring rotates about substantially the rigid ring axis.

In another aspect, a clock is disclosed that includes a clock movement, first and second drive wheels, a cover, a first rigid ring, a second rigid, first through fourth pluralities of protrusions, and first through fourth pluralities of indentations.

The clock movement comprises a case, a battery compartment configured to interconnect to a battery, a motor disposed within the case, a gear train, a mounting bushing, an inner output shaft driven at a first angular rate by the motor, an outer output shaft driven at a second angular rate by the motor, and a support bushing. The mounting bushing is an elongated tubular member. The mounting bushing comprises a proximal end and a distal end. The proximal end of the mounting bushing is fixed to the case. The first angular rate is different than the second angular rate. The inner shaft and the outer shaft are coaxial. The inner shaft is at least partially disposed within the outer shaft. The outer shaft and the mounting bushing are coaxial along an axis of rotation. The outer shaft is at least partially disposed within the mounting bushing. The support bushing is fixed relative to the distal end of the mounting bushing. A bearing portion of the support bushing is positioned distal to the mounting bushing. The bearing portion of the support bushing includes an annular bearing surface surrounding a bearing portion of the outer output shaft. No portion of the clock movement is disposed between the annular bearing surface and the bearing portion of the outer output shaft. A load applied to the outer output shaft perpendicular to the axis of rotation at a distal end of the outer output shaft causes a reaction force on the outer output shaft from the annular bearing surface.

The first drive wheel is fixed to the outer output shaft and the second drive wheel is fixed to the inner output shaft. The second drive wheel comprises a shaft portion disposed along the axis of rotation and distal to a distal end of the inner output shaft.

The clock movement and the first and second drive wheels are disposed within the cover. The cover comprises a first slot aligned with the first drive wheel. The cover comprises a second slot aligned with the second drive wheel. The cover comprises a hole. The shaft portion of the second drive wheel is at least partially disposed within the hole. The hole comprises a bearing portion in contact with the shaft portion. The first and second drive wheels are disposed between the support bushing and the hole.

The first rigid ring comprises a first inner annular surface which is suspended by the first drive wheel. The first rigid ring comprises an hour demarcation to represent the hour. The first inner annular surface of the first rigid ring is in contact with the first drive wheel so as to rotate the first rigid ring at a different angular rate than the first drive wheel so that the first rigid ring rotates through one complete revolution once every twelve hours allowing the hour of the day to be interpreted using traditional clock interpretation means. The first rigid ring is held in contact with the first drive wheel by the force of gravity. A portion of the first rigid ring is disposed within the first slot. The first rigid ring rotates about a rigid ring axis. The rigid ring axis is not coaxial with the axis of rotation.

A second rigid ring comprises a second inner annular surface which is suspended by the second drive wheel. The second rigid ring comprises a minute demarcation to represent the minute of the hour. The second inner annular surface of the second rigid ring is in contact with the second drive wheel so as to rotate the second rigid ring at a different angular rate than the second drive wheel so that the second rigid ring rotates through one complete revolution once every hour allowing the minute of the hour to be interpreted using traditional clock interpretation means. The second rigid ring is held in contact with the second drive wheel by the force of gravity. A thickness of the second rigid ring is less than the width of the second slot. A portion of the second rigid ring is disposed within the second slot. The second rigid ring rotates about substantially the rigid ring axis.

The first drive wheel comprises the first plurality of protrusions and the first plurality of protrusions are disposed about a perimeter of the first drive wheel. Each protrusion of the first plurality of protrusions is disposed within a first plane. The first plane is perpendicular to the axis of rotation.

The first drive wheel comprises the second plurality of protrusions and the second plurality of protrusions are disposed about the perimeter of the first drive wheel. Each protrusion of the second plurality of protrusions is disposed within a second plane. The second plane is perpendicular to the axis of rotation. The first plane is parallel to and offset from the second plane. The first plurality of protrusions is circumferentially offset from the second plurality of protrusions such that as the first drive wheel rotates about the axis of rotation, individual protrusions from the first and second pluralities of protrusions alternately occupy a top dead center position.

The first rigid ring comprises the first plurality of indentations and the first plurality of indentations are disposed along the first inner annular surface. Each indentation of the first plurality of indentations is disposed within the first plane when the first rigid ring is suspended by the first drive wheel. The first plurality of indentations are configured to mesh with the first plurality of protrusions as the first drive wheel rotates.

The first rigid ring comprises the second plurality of indentations and the second plurality of indentations are disposed along the first inner annular surface. Each indentation of the second plurality of indentations is disposed within the second plane when the first rigid ring is suspended by the first drive wheel. The second plurality of indentations are configured to mesh with the second plurality of protrusions as the first drive wheel rotates.

The second drive wheel comprises the third plurality of protrusions and the third plurality of protrusions are disposed about a perimeter of the second drive wheel. Each protrusion of the third plurality of protrusions is disposed within a third plane. The third plane is perpendicular to the axis of rotation.

The second drive wheel comprises the fourth plurality of protrusions and the fourth plurality of protrusions are disposed about the perimeter of the second drive wheel. Each protrusion of the fourth plurality of protrusions is disposed within a fourth plane. The fourth plane is perpendicular to the axis of rotation. The third plane is parallel to and offset from the fourth plane. The third plurality of protrusions is circumferentially offset from the fourth plurality of protrusions such that as the second drive wheel rotates about the axis of rotation, individual protrusions from the third and fourth pluralities of protrusions alternately occupy a top dead center position.

The second rigid ring comprises the third plurality of indentations and the third plurality of indentations are disposed along the second inner annular surface. Each indentation of the third plurality of indentations is disposed within the third plane when the second rigid ring is suspended by the second drive wheel. The third plurality of indentations are configured to mesh with the third plurality of protrusions as the second drive wheel rotates.

The second rigid ring comprises the fourth plurality of indentations and the fourth plurality of indentations are disposed along the second inner annular surface. Each indentation of the fourth plurality of indentations is disposed within the fourth plane when the second rigid ring is suspended by the second drive wheel. The fourth plurality of indentations are configured to mesh with the fourth plurality of protrusions as the second drive wheel rotates.

In an arrangement, each individual protrusion of the first and second pluralities of protrusions may comprise a first draft angle in a plane that contains an entirety of the axis of rotation. The first draft angle of the first plurality of protrusions faces the second plurality of protrusions, and the first draft angle of the second plurality of protrusions faces the first plurality of protrusions. The first draft angle is disposed such that a portion of an indentation of the first and second pluralities of indentations in contact with the first draft angle will slide down to a bottom of the first draft angle and cause the first rigid ring to be in alignment with the first drive wheel.

Also, in such an arrangement, each individual protrusion of the third and fourth pluralities of protrusions may comprise a second draft angle in a plane that contains an entirety of the axis of rotation. The second draft angle of the third plurality of protrusions faces the fourth plurality of protrusions, and the second draft angle of the fourth plurality of protrusions faces the third plurality of protrusions. The second draft angle is disposed such that a portion of an indentation of the third and fourth pluralities of indentations in contact with the second draft angle will slide down to a bottom of the second draft angle and cause the second rigid ring to be in alignment with the second drive wheel.

In arrangements of the current aspect, the locations of the protrusions and indentations may be reversed such that the protrusions are disposed on the first and second rings and the indentations are disposed on the first and second drive wheels. Moreover, in an arrangement, the rigid rings and drive wheels may each include both indentations and protrusions; for example the first drive wheel may contain protrusions in the first plane and indentations in the second plane while the first rigid member may contain indentations in the first plane and protrusions in the second plane, thus limiting the first rigid member to only be installed on the first drive wheel in a particular orientation.

Additional aspects and advantages will become apparent to one skilled in the art upon consideration of the further description that follows. It should be understood that the detailed description and specific examples are intended for purposes of illustration only and are not intended to limit the scope of the invention. Furthermore, any of the above aspects, arrangements, features, and embodiments may be combined with any other of the above aspects, arrangements, features, and embodiments where appropriate.

BRIEF DESCRIPTION OF THE DRAWINGS

Reference is now made to the following Detailed Description of the Invention taken in conjunction with the accompanying drawings, wherein:

FIG. 21 illustrates an alternate minute indicator ring.

FIG. 22 is a detail view of a portion of an inner annular surface of the minute indicator ring of FIG. 21.

FIG. 28 illustrates another alternate minute indicator ring.

FIG. 29 is a detail view of a portion of an inner annular surface of the minute indicator ring of FIG. 28.

DETAILED DESCRIPTION OF THE INVENTION

In the following description, embodiments are set forth in the context of apparatuses and methods for clocks with unique time displays that are interpreted using traditional clock interpretation methods.

Figure 1:
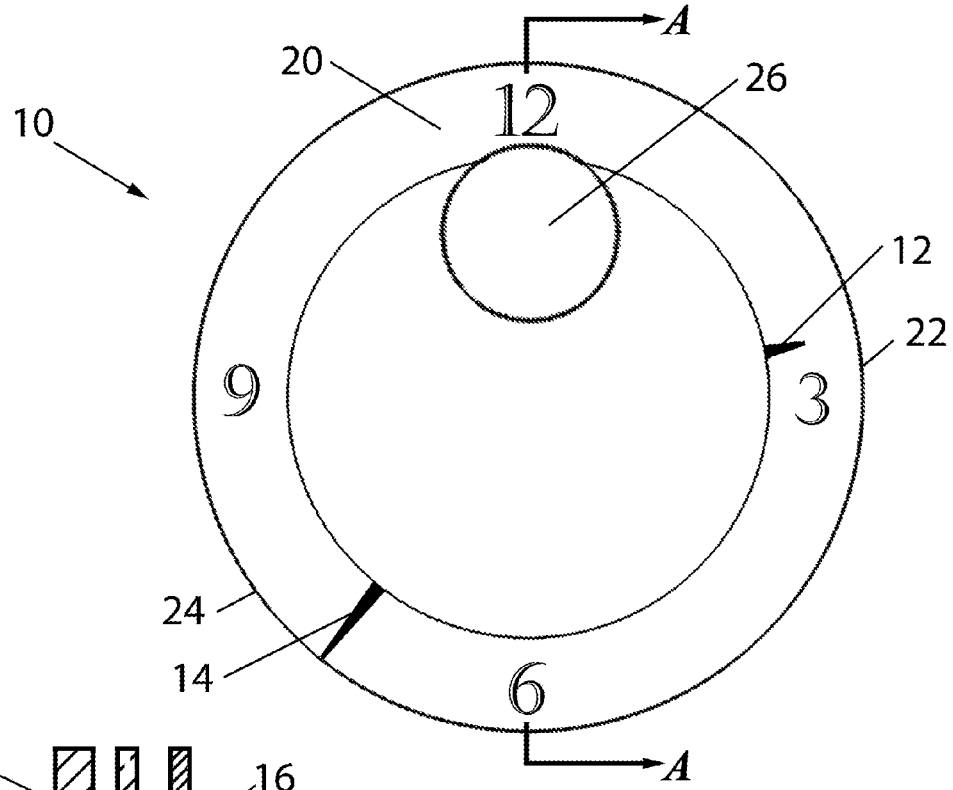
FIG. 1 shows an apparatus for the display of time using two clear rigid rings with indicators for hour and minute, a stationary rigid ring with numerals to aid in the interpretation of the indicated time, and a movement which rotates the two clear rigid rings by acting on the inner annular surfaces of the two clear rigid rings.
Figure 2:
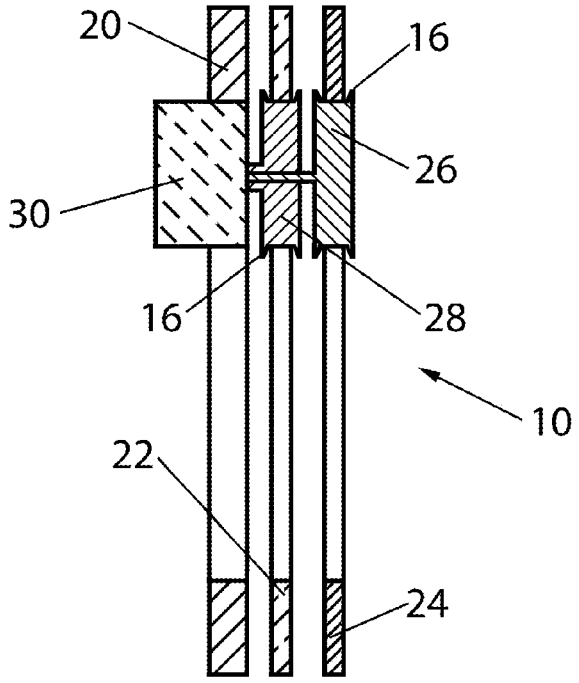
FIG. 2 shows a section view of the apparatus of FIG. 1.

FIGS. 1 and 2 illustrate an embodiment of a clock 10 with a unique time display. The motion of the clock 10 is driven by a movement 30 that drives a minute indicator drive wheel 26 and an hour indicator drive wheel 28. The movement 30 can be mounted on a wall or a frame to allow a minute indicator ring 24 and an hour indicator ring 22 to hang freely from the minute indicator drive wheel 26 and the hour indicator drive wheel 28, respectfully. A demarcation ring 20 may also be interconnected to the movement 30. The demarcation ring 20 may be stationary relative to non-moving parts of the movement 30.

As illustrated, the demarcation ring 20 has the numerals 3, 6, 9, and 12 placed at their corresponding clock positions to aid the viewer in the determination of the indicated time. Alternately, all of the clock numerals 1 through 12, roman numerals, or other graphic indication could be used on the demarcation ring 20 to aid the viewer in the determination of the indicated time. In another alternative, the demarcation ring 20 may have no indicators to aid the viewer in the determination of the indicated time. The demarcation ring 20 is not a driven member and does not move. The demarcation ring 20 may rest on the body of the movement 30 or on a member at least partially encasing the movement 30.

The minute indicator ring 24 may be constructed of a clear material which allows for the hour indicator ring 22 to be viewed through the minute indicator ring 24. The hour indicator ring 22 may be constructed of a clear material which allows for the demarcation ring 20 to be viewed through the minute indicator ring 24 and the hour indicator ring 22. The minute indicator ring 24 may have a minute indicator 14 to denote the minute of the hour. The minute indicator 14 may, for example, be printed on, attached to, or machined into, the minute indicator ring 24. For example, the minute indicator 14 may be a sticker affixed to the minute indicator ring 24. Likewise, the hour indicator ring 22 has an hour indicator 12 to denote the hour. The hour indicator may be smaller than the minute indicator 14. The hour indicator 12 may, for example, be printed on, attached to, or machined into the hour indicator ring 22.

The minute indicator drive wheel 26 and an hour indicator drive wheel 28 may each have small flanges 16 that may keep the minute indicator ring 24 and the hour indicator ring 22, respectively, properly aligned with respect to each other and the demarcation ring 20. The movement 30 rotationally drives the minute indicator drive wheel 26 at a rate such that the minute indicator ring 24 is rotated 360 degrees every 60 minutes. The movement 30 rotationally drives the hour indicator drive wheel 28 at a rate such that the hour indicator ring 22 is rotated 360 degrees every 12 hours. The resulting effect is that the clock has a unique design that does not have traditional clock hands, yet the time is interpreted using traditional clock interpretation methods. The time may be set by manually positioning the time indicating rings so that the indicators 12, 14 are oriented properly. Thus, there may be no need to have a time adjustment mechanism on the movement 30.

Figure 3:
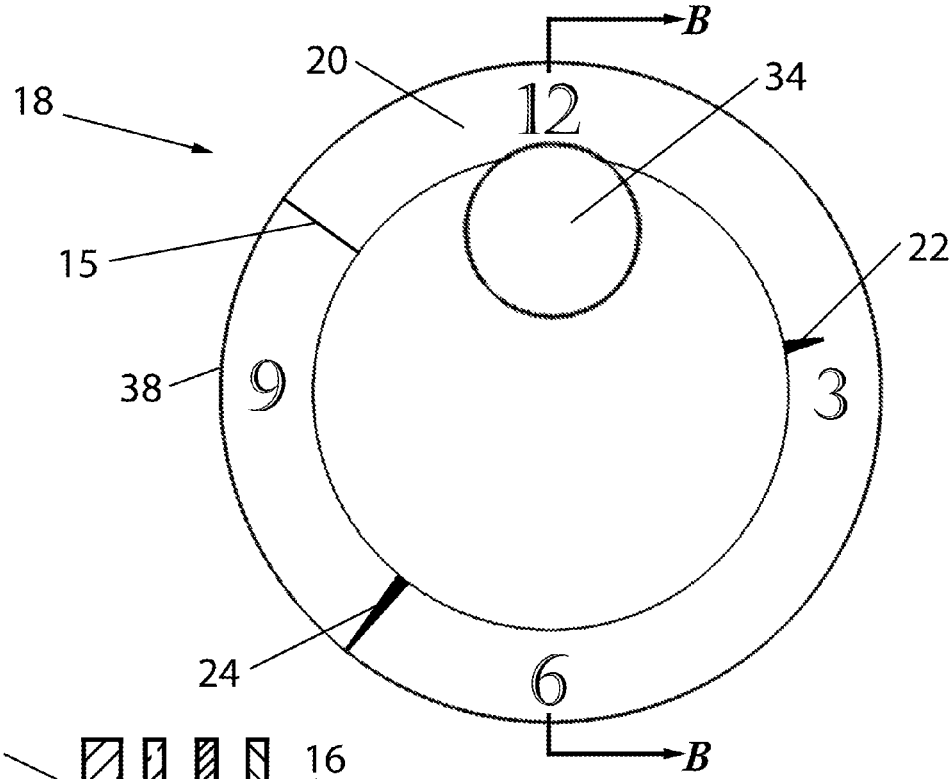
FIG. 3 shows an apparatus similar to that of FIGS. 1 and 2 with a third rigid ring to indicate time and a movement with additional support at the end of the output shafts which rotate the three clear rigid rings by acting on the inner annular surfaces of the three clear rigid rings.
Figure 4:
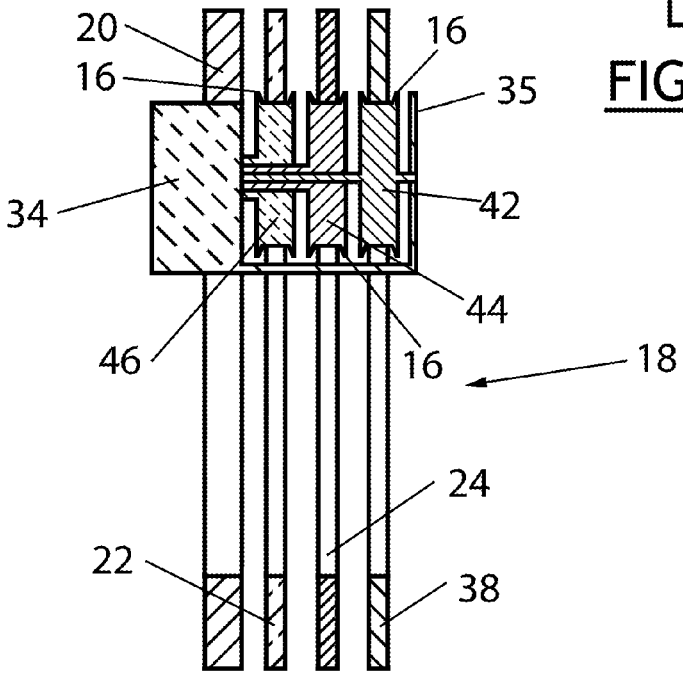
FIG. 4 shows a section view of the apparatus of FIG. 3.

An additional embodiment of a clock 18 is shown in FIGS. 3 and 4. This embodiment is similar to the embodiment of FIG. 1 but with the addition of a seconds indictor drive wheel 42 to a movement with support arm 34 and a seconds indicator ring 38. The seconds indicator ring 38 may be constructed of a clear material which allows for the minute indicator ring 24 to be viewed through the seconds indicator ring 38. The seconds indicator ring 38 may have a seconds indicator 15 to denote the second of the minute. The seconds indicator 15 may, for example, be printed on, attached to, or machined into the seconds indicator ring 38.

The seconds indicator drive wheel 42 may have small flanges 16 that keep the seconds indicator ring 38 aligned with respect to the minute indicator ring 24, the hour indicator ring 22, and the demarcation ring 20. The movement with support arm 34 rotationally drives the seconds indicator drive wheel 42 at a rate such that the seconds indicator ring 38 is rotated 360 degrees every minute. The movement with support arm 34 has a support arm 35 extending from the body of the movement and supporting the far end of the drive shafts for the drive wheels 42, 44 and 46. The resulting effect is that the clock 18 has a unique design that does not have the traditional clock hands, yet the time is interpreted using traditional clock interpretation methods.

Figure 5:
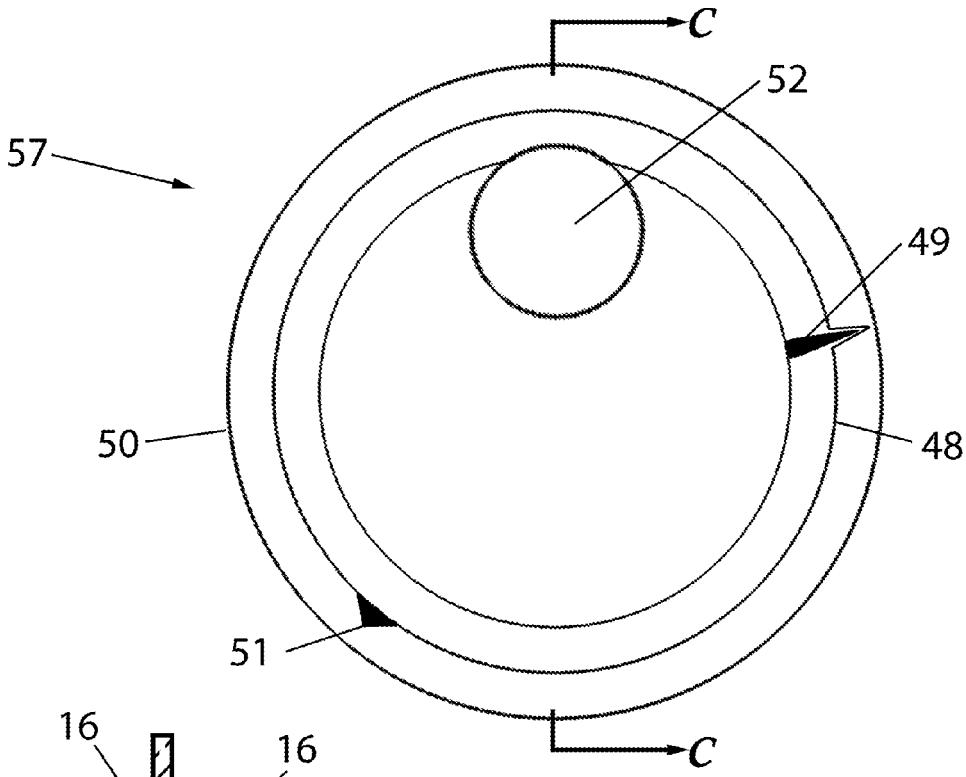
FIG. 5 shows an apparatus for the display of time using two opaque rigid rings with indicators for hour and minute and a movement, which rotates the two opaque rigid rings by acting on the inner annular surfaces of the two opaque rigid rings.
Figure 6:
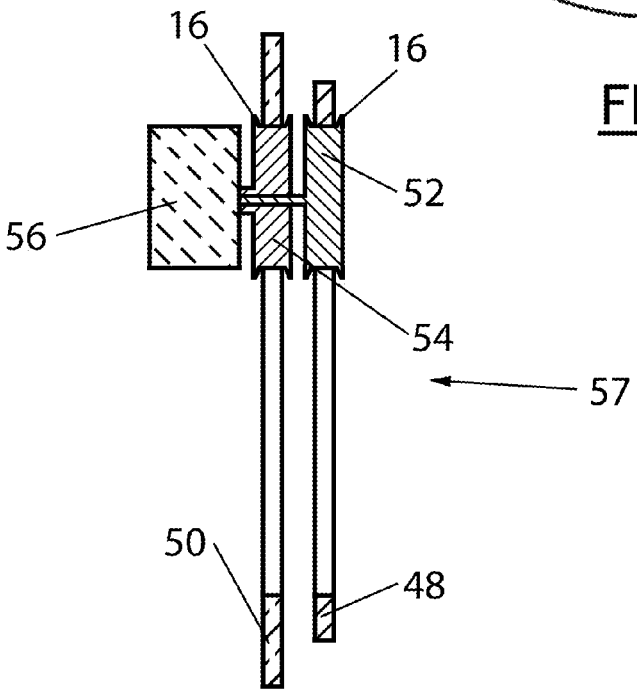
FIG. 6 shows a section view of the apparatus of FIG. 5.

An additional embodiment of a clock 57 is shown in FIGS. 5 and 6. In this embodiment, the clock 57 is driven by a movement 56 that drives an hour indicator drive wheel 54 and a minute indicator drive wheel 52. The movement 56 can be mounted on a wall or a frame to allow an hour indicator ring 50 and a smaller minute indicator ring 48 to hang freely. The hour indicator ring 50 and the minute indicator ring 48 may be constructed of an opaque material. The hour indicator ring 50 may have an hour indicator 51 to denote the hour. The hour indicator 51 may, for example, be printed on, attached to, or machined into the hour indicator ring 50. Likewise the minute indicator ring 48 may have a minute indicator 49. The minute indicator 49 may extend beyond the outer diameter of the minute indicator ring 48 to assist in communicating to an observer that it indicates the minute of the hour. The minute indicator 49 may, for example, be printed on, attached to, or machined into the minute indicator ring 48.

The hour indicator drive wheel 54 and the minute indicator drive wheel 52 may have small flanges 16 which keep the hour indicator ring 50 and the minute indicator ring 48 properly aligned with respect to each other. The movement 56 rotationally drives the hour indicator drive wheel 54 at a rate such that the hour indicator ring 50 is rotated 360 degrees every 12 hours. The movement 56 rotationally drives the minute indicator drive wheel 52 at a rate such that the minute indicator ring 48 is rotated 360 degrees every 60 minutes. The minute indicator ring 48 is sized so that the hour indicator 51 on the hour indicating ring 50 is not blocked from view. The resulting effect is that the clock 57 has a unique design that does not have the traditional clock hands, yet the time is interpreted using traditional clock interpretation methods.

Figure 7:
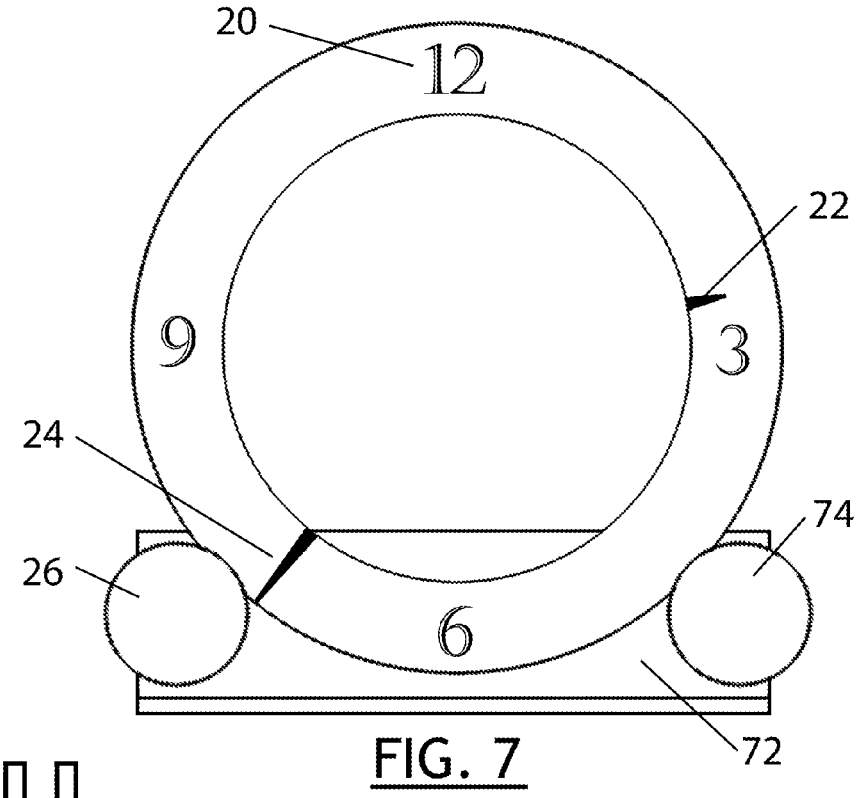
FIG. 7 shows an apparatus for the display of time using two clear rigid rings with indicators for hour and minute, a stationary rigid ring with numerals to aid in the interpretation of the indicated time and a movement, which rotates the clear rigid rings by acting on their outer annular surfaces.
Figure 8:
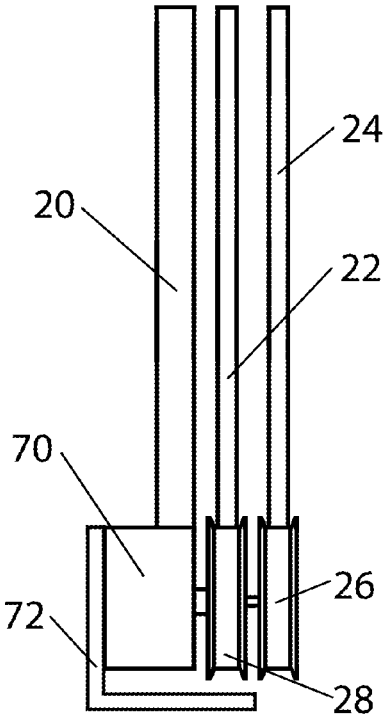
FIG. 8 shows a side view of the apparatus of FIG. 7.

An additional embodiment is shown in FIGS. 7 and 8. This embodiment may include demarcation ring 20, minute indicator ring 24, hour indicator ring 22, minute indicator drive wheel 26, and hour indicator drive wheel 28. However, in this embodiment the minute indicator ring 24 and hour indicator ring 22 are driven respectively by the minute indicator drive wheel 26 and hour indicator drive wheel 28 on the outside surface of the indicator rings 24 and 22. An outside drive movement 70 rotationally drives the minute indicator drive wheel 26 at a rate such that the minute indicator ring 24 is rotated 360 degrees every 60 minutes. The outside drive movement 70 rotationally drives the hour indicator drive wheel 28 at a rate such that the hour indicator ring 22 is rotated 360 degrees every 12 hours. The minute indicator ring 24 and hour indicator ring 22 are held against the drive wheels and idler wheels 74 by the force of gravity. The idler wheels 74 rotate freely about an axis through their centers. The demarcation ring 20 is stationary.

The demarcation ring 20 has the numerals 3, 6, 9, and 12 placed at their corresponding clock positions to aid the viewer in the determination of the indicated time. Alternately, all of the clock numerals 1 through 12, roman numerals, or other graphic indications could be used on the demarcation ring 20 to aid the viewer in the determination of the indicated time.

The minute indicator ring 24 and the hour indicator ring 22 are constructed of a clear material which allows for the demarcation ring 20 to be viewed through the minute indicator ring 24 and the hour indicator ring 22. The minute indicator drive wheel 26 and an hour indicator drive wheel 28 may have small flanges which keep the minute indicator ring 24 and the hour indicator ring 22 properly aligned with respect to each other and the demarcation ring 20. The outside drive movement 70 and idler wheels 74 are mounted to a support frame 72 which in turn can be placed on a horizontal surface, such as a desk for use as a desk clock, or attached to a wall for use as a wall clock. The resulting effect is that the clock has a unique design that does not have the traditional clock hands, yet the time is interpreted using traditional clock interpretation methods. The movement 70 may drive the minute indicator drive wheel 26 and an hour indicator drive wheel 28 in a counterclockwise direction such that the minute indicator ring 24 and the hour indicator ring 22 are driven in a clockwise direction.

Figure 9:
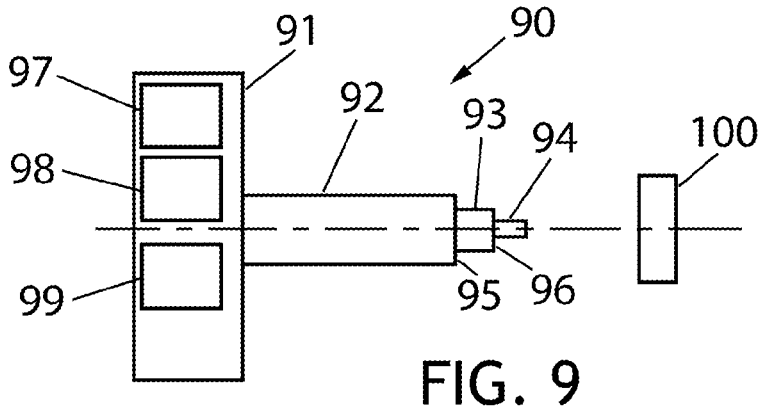
FIG. 9 is an exploded side view of a typical clock movement and a support bushing.

FIG. 9 is an exploded side view diagram of a clock movement 90 and a support bushing 100. A "clock movement" or "movement" is a device that converts stored energy into consistent movement of members. In a typical application, indicators (e.g., hands) may be fixed to the consistently moving members and the position of such indicators may be used to indicate time (e.g., the time of day). A common type of movement is a battery powered movement with output shafts to which minute and hour hands are attached. Such a movement converts the energy stored in a battery into the rotation of an hour shaft that rotates once every twelve hours and into the rotation of a minute shaft that rotates once every hour.

The movement 90 may include a case 91 and a mounting bushing 92 fixed to the case 91. The movement 90 may include an hour output shaft 93 and a minute output shaft 94. The minute output shaft 94 may be disposed within, and be coaxial with, the hour output shaft 93. Accordingly, the hour output shaft 93 may include a hollow tubular portion that surrounds a portion of the minute output shaft 94. The movement 90 may also include a seconds output shaft (not shown), which may be disposed within, and coaxial with, the minute output shaft 94.

As illustrated, the hour output shaft 93 may extend beyond a distal end 95 of the mounting bushing 92 and the minute output shaft 94 may extend beyond a distal end 96 of the hour output shaft 93. The mounting bushing 92 is typically an elongated tubular member. The mounting bushing 92 is typically constructed from metal (e.g., brass) and is typically rigidly fixed to the case 91 at a proximal end of the mounting bushing 92. The mounting bushing 92 is typically threaded such that the movement 90 may be attached to a clock dial by positioning the mounting bushing 92 through a hole in the clock face and then placing a nut on the threads of the mounting bushing 92 to capture the clock face between the nut and the case 91. In this manner, the clock face may support the movement 90 or the movement 90 may support the clock face.

The case 91 may contain a compartment 97 (e.g., a battery compartment) for holding a power source, such as a replaceable battery (such as an AA or C sized battery). The compartment 97 may be configured such that positive and negative terminals of a battery placed therein are in contact with electrical conductors that in turn are interconnected to a motor 98. The motor 98 may be disposed within the case 91. The motor 98 may be operable to convert energy from the power source into movement of a gear train 99 that is interconnected to the hour output shaft 93 and the minute output shaft 94 (and a seconds output shaft if included). Thus, the motor 98 may drive the hour output shaft 93 and the minute output shaft 94, with the hour output shaft 93 being driven at a first angular rate and the minute output shaft 94 being driven at a second, different angular rate. For example, in a typical clock, one shaft will be driven at a rate twelve times faster than the other shaft. In a twenty-four hour clock, one shaft may be driven at a rate twenty-four times faster than the other shaft.

The support bushing 100 may be configured to fixedly attach to the mounting bushing 92 to provide support for the hour output shaft 93 proximate to the distal end 95 of the mounting bushing 92.

Figures 10A, 10B, 10C:
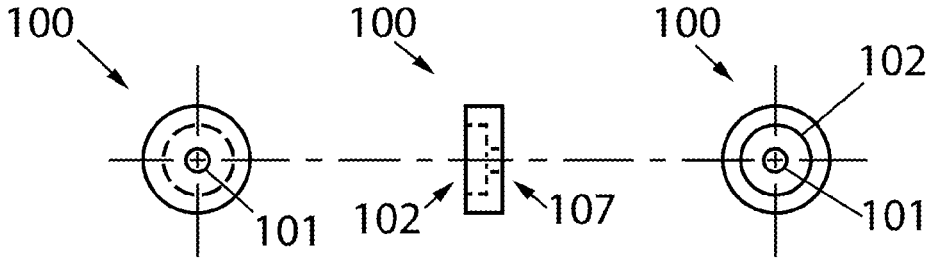
FIGS. 10A, 10B and 10C are illustrations of the support bushing of FIG. 9.

FIGS. 10A through 10C illustrate an exemplary configuration of the support bushing 100. FIG. 10A is a front view of the support bushing 100, FIG. 10B is a side view of the support bushing 100, and FIG. 10B is a rear view of the support bushing 100. The "front view" as used herein refers to the view seen by a user of a clock as the user interprets the time indicated by the clock.

The support bushing 100 includes a through hole 101 that is sized to fit over the hour output shaft 93 such that the inner surface of the through hole 101 may provide an annular bearing surface for the outer surface of the hour output shaft 93. A portion of the support bushing 100 that includes the inner surface of the through hole 101 may be a bearing portion 107 of the support bushing 100. When the support bushing 100 is installed on the mounting bushing 92, the bearing portion 107 may be disposed distal to the distal end 95 of the mounting bushing 92.

In an exemplary configuration, the through hole 101 may be sized such that it is less than 0.0005 inches greater in diameter than the outer surface of the hour output shaft 93. Alternatively, through hole 101 diameters of up to 0.002 inches greater in diameter than the outer surface of the hour output shaft 93 may be used. Alternatively, through hole 101 diameters of up to 0.010 inches greater in diameter than the outer surface of the hour output shaft 93 may be used. The width of the inner surface of the through hole 101 may be sized to provide support to the hour output shaft 93 without detrimentally gouging the outer surface of the hour output shaft 93. In another embodiment, the through hole 101 need not be round. Since the movement 90 will generally be placed in a predictable orientation, the through hole 101 need not be round as long as it provides a bearing surface just below (downward in FIG. 11) the hour output shaft 93. Indeed, in such a support, a through hole is not required as only the bearing surface just below (downward in FIG. 11) the hour output shaft 93 is needed.

The support bushing 100 may comprise a low friction material such that friction between the inner surface of the through hole 101 and the hour output shaft 93 is acceptably low. For example, the support bushing 100 may comprise polyoxymethylene, polytetrafluoroethylene, or any other appropriate low friction material.

The support bushing 100 may also include a mounting bushing interface region 102. For example, mounting bushing interface region 102 may comprise a threaded portion sized to mate with the threaded portion of the mounting bushing 92. In one example, the support bushing 100 may be a unitary member (e.g., made from a single piece of polymer). In another example, the mounting bushing interface region 102 may comprise a metal (e.g., brass) nut sized to interface with the threaded portion of the mounting bushing 92. Such a nut may be pressed into the support bushing 100 or otherwise fixed to the support bushing 100 such that the support bushing 100 may be interconnected to the mounting bushing 92. Such a nut may be a lock nut. In this regard, the support bushing 100 may be a two-piece member with a first portion comprising a polymer that includes the bearing surface of the through hole 101 and a second portion comprising a metal nut that is interconnected to the first portion and includes the mounting bushing interface region 102. In another example, the mounting bushing interface region 102 may be sized that it may be pressed onto the threaded portion of the mounting bushing 92 such that it becomes fixed to the mounting bushing 92. In such an arrangement, the mounting bushing interface region 102 may not include any threads. An adhesive may be used to fix the support bushing 100 to the mounting bushing 92.

Although illustrated as having an outer surface that is circular, the outer surface of the support bushing 100 may be hexagonal such that it may be tightened onto the mounting bushing 92 using a wrench or socket. Alternatively, the outer surface of the support bushing 100 may be any other appropriate shape (e.g., square).

Figure 11:
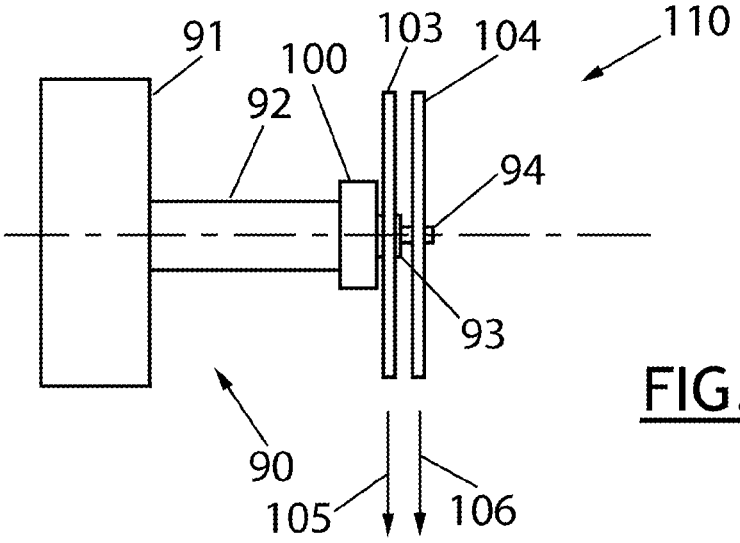
FIG. 11 shows the support bushing of FIGS. 9 and 10 installed on the clock movement of FIG. 9.

FIG. 11 illustrates a clock assembly 110 that includes the movement 90 with the support bushing 100 installed onto the mounting bushing 92. An hour indicator drive wheel 103 is shown interconnected to the hour output shaft 93. The hour indicator drive wheel 103 may, for example, be configured to press on to the hour output shaft 93 such that the hour indicator drive wheel 103 and the hour output shaft 93 move together at the same rotational rate. Any other appropriate method of interconnecting the hour indicator drive wheel 103 to the hour output shaft 93 may be used. A minute indicator drive wheel 104 is shown interconnected to the minute output shaft 94. The minute indicator drive wheel 104 may, for example, be configured to screw on to a threaded portion of the minute output shaft 94 such that the minute indicator drive wheel 104 and the minute output shaft 94 move together at the same rotational rate. Any other appropriate method of interconnecting the minute indicator drive wheel 104 to the minute output shaft 94 may be used.

An hour indicator ring (not shown in FIG. 11) may be hung on the hour indicator drive wheel 103 such that the rotation of the hour indicator drive wheel 103 will cause the hour indicator ring to rotate at a predetermined rate, such as one complete revolution every 12 hours. A minute indicator ring (not shown in FIG. 11) may be hung on the minute indicator drive wheel 104 such that the rotation of the minute indicator drive wheel 104 will cause the minute indicator ring to rotate at a predetermined rate, such as one complete revolution every 60 minutes. This is similar to how the rings 22 and 24 of the clock 10 of FIG. 1 are driven.

When the movement 90 is in a typical operating position (e.g., hanging from a wall), the hour indicator ring and the hour indicator drive wheel 103 will impart a downward force (due to gravity) on the hour output shaft 93 where the hour indicator drive wheel 103 interfaces with the hour output shaft 93. This force is illustrated by directional arrow 105. Similarly, the minute indicator ring and the minute indicator drive wheel 104 will impart a downward force (due to gravity) on the minute output shaft 94 where the minute indicator drive wheel 104 interfaces with the minute output shaft 94. This force is illustrated by directional arrow 106.

Without the support bushing 100 in the clock assembly 110, the forces illustrated by directional arrows 105 and 106 may cause the output shafts 93 and 94 to be out of alignment with the mounting bushing 92. Such lack of alignment may cause binding between components of the clock assembly 110 which may lead to premature stoppage of moving parts such as the output shafts 93, 94, rendering the clock assembly 110 inoperable. Such stoppage may occur independently of the voltage of the battery or other power source used to power the clock assembly 110. In other words, the clock assembly 110 may be inoperable even if fresh batteries are used. In another failure mode, such lack of alignment may cause increased internal friction such that the clock assembly 110 becomes inoperable when the battery or other power source used to power the clock assembly 110 drops below a certain output level. For example, a typical movement may incorporate an AA battery that typically has a voltage of about 1.6 volts when new. As the battery powers the movement, the battery's voltage may drop. A typical movement may continue to function as the battery's voltage drops, for example, to 1.3 volts or below. However, if there is increased friction due to a lack of alignment between output shafts 93 and 94 and the mounting bushing 92, the movement may be able to function when the battery is new, but may become inoperable when the battery voltage drops below, for example, 1.4 volts. Such a failure would result in users needing to replace batteries at a much higher frequency as compared to movements capable of functioning when voltages drop to 1.3 volts or below.

Such friction may occur at one or more locations. For example, the forces illustrated by directional arrows 105 and 106 may cause the output shaft 93 to be in contact with the mounting bushing 92 near the distal end 95 (not visible in FIG. 11) of the mounting bushing 92. This contact may, for example, be between an edge of the brass of the mounting bushing 92 and the plastic of the hour output shaft 93. In another example, the forces illustrated by directional arrows 105 and 106 may cause meshing gears within the movement 90 to be pressed toward each other such that frictional forces between such gears are increased. In yet another example, the forces illustrated by directional arrows 105 and 106 may cause frictional forces between the output shafts 93 and 94 and internal bearings used position the output shafts 93 and 94. One or more of these and other sources of increased friction may occur due to the forces illustrated by directional arrows 105 and 106. These forces may result in complete or premature stoppage of the clock assembly 110.

The support bushing 100 counteracts the forces illustrated by directional arrows 105 and 106 by supporting the output shafts 93 and 94 near the distal end 95 of the mounting bushing 92. In this regard, loads applied perpendicular to the hour and/or minute output shafts 93,94 at their respective distal ends (as illustrated by directional arrows 105 and 106) may cause the hour output shaft 93 to be pressed against the annular bearing surface provided by the inner surface of the through hole 101.

The support bushing 100 may be made of a low friction material such as described above such that the friction between the support bushing 100 and the hour output shaft 93 is low enough to not detrimentally affect the performance of the clock assembly 110. Through the support bushing 100 being fixedly interconnected to the mounting bushing 92 as described above, the forces illustrated by directional arrows 105 and 106 may be counteracted by the mounting bushing 92. This is in contrast to the clock assembly 110 without the support bushing 100 where the forces illustrated by directional arrows 105 and 106 may cause misalignment and increased friction as described above.

Thus, the use of a support bushing 100 may allow existing clock movements to drive members that are significantly heavier and/or larger while maintaining satisfactory battery performance (e.g., remaining operational as battery voltage drops to acceptable levels). In this regard, a given clock movement may be capable of moving larger and/or longer hands when a support bushing 100 is utilized. Also, the support bushing 100 may, for example, allow a typical clock movement to satisfactorily drive members that are heavier than typical clock hands, such as the combination of indicator drive wheels 26, 28 and indicator rings 22, 24 of FIG. 1.

Figure 12:
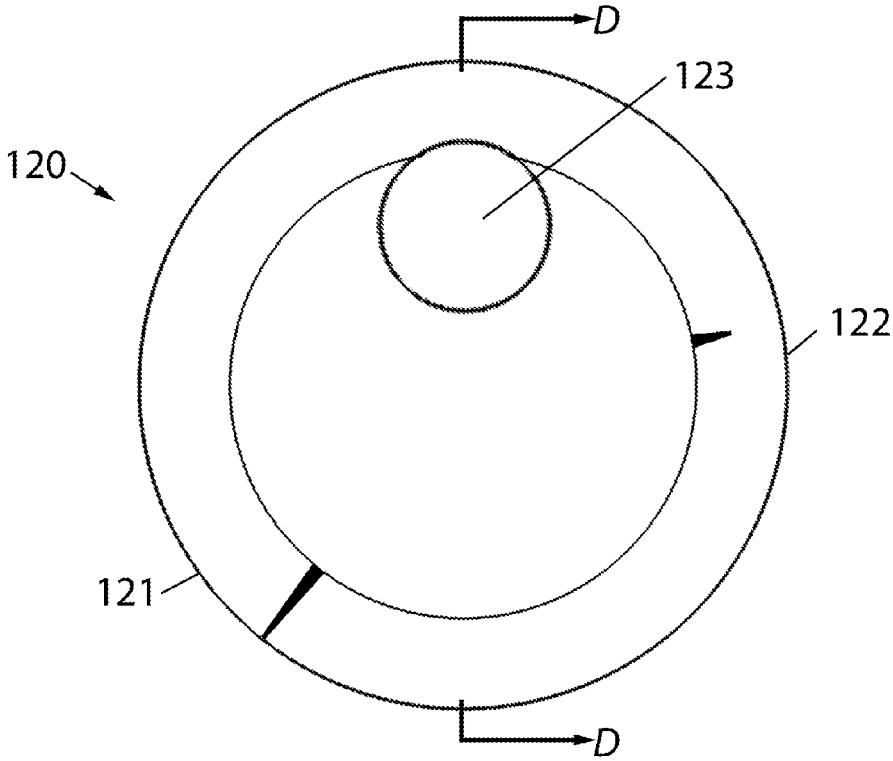
FIG. 12 illustrates an apparatus for the display of time using two rigid rings and the movement of FIG. 11 which rotates the two rigid rings by acting on the inner annular surfaces of the two rigid rings.
Figure 13:
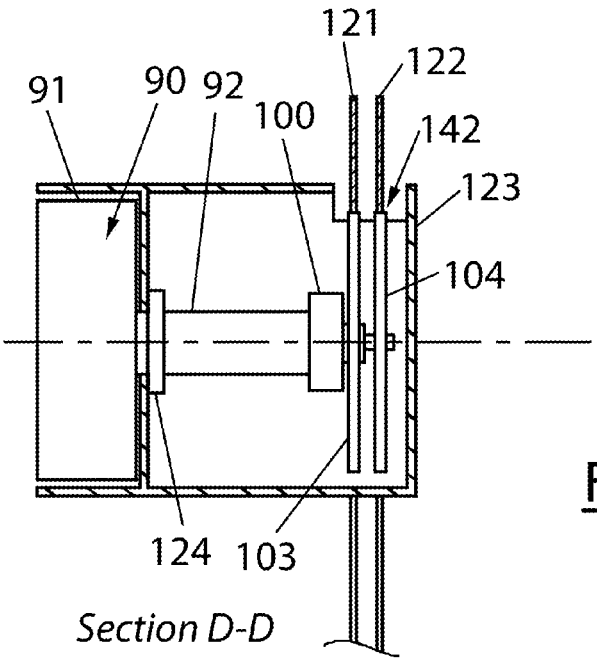
FIG. 13 illustrates a section view of the apparatus of FIG. 12.

FIG. 12 illustrates an apparatus 120 for the display of time, and FIG. 13 illustrates a partial cut away side view the apparatus 120. The apparatus 120 includes two rigid rings: a minute indicator ring 122 and an hour indicator ring 121. The hour indicator ring 121 is positioned behind the minute indicator ring 122 and visible through the minute indicator ring 122 in FIG. 12. The apparatus 120 further includes the movement 90 and support bushing 100 positioned within a cover 123. The apparatus 120 also includes hour indicator drive wheel 103 and minute indicator drive wheel 104. The minute indicator ring 122 and hour indicator ring 121 are held in place and in contact with the minute indicator drive wheel 104 and hour indicator drive wheel 103, respectively, by the force of gravity. Thus, when the minute indicator drive wheel 104 and hour indicator drive wheel 103 are rotated (e.g., driven by the movement 90), the minute indicator ring 122 and hour indicator ring 121, respectively, are also driven.

The indicator rings 121 and 122 may be configured in a variety of ways to produce aesthetic variations. For example, the hour indicator ring 121 may be opaque (e.g., metal such as aluminum or an opaque polymer) and the minute indicator ring 122 may be transparent (e.g., clear or tinted polymer or clear or tinted glass). In another example, both the hour indicator ring 121 and the minute indicator ring 122 may be transparent. In another example, both the hour indicator ring 121 and the minute indicator ring 122 may be constructed of opaque materials with the minute indicator ring 122 being configured such that the hour indicator ring 121 is visible through the minute indicator ring 122, such as through a series of cutouts or through holes in the minute indicator ring 122. In another example, the apparatus 120 may include a demarcation ring, such as the demarcation ring 20 of FIG. 1. Such a demarcation ring may be supported by the cover 123.

The cover 123 may be configured to at least partially conceal the movement 90, support bushing 100, and indicator drive wheels 103, 104. The movement 90 may be interconnected to the cover 123 by fixing a portion of the cover 123 between the case 90 and a nut 124 positioned on the mounting bushing 92. The cover 123 may comprise multiple separate pieces that are interconnected (e.g., by snaps or by screws) to each other. Thus an exemplary method of assembly may be to first fix the movement 90 to a first portion of the cover 123 using the nut 124, then install the support bushing 100 and indicator drive wheels 103, 104, followed by interconnecting a second portion of the cover 123, and finally, placing the indicator rings 121, 122 on the indicator drive wheels 103, 104. In an alternative embodiment, the cover 123 may be attached to (e.g., by snapping onto) the case 90 without using the mounting bushing 92. Such an alternative does not need the portion of the cover 123 adjacent to the front face of the case 91 and therefore could be constructed as a single unitary member. In such an alternative, a fully assembled movement 90 with support bushing 100 and indicator drive wheels 103, 104 could be inserted into the cover 123.

Figure 14:
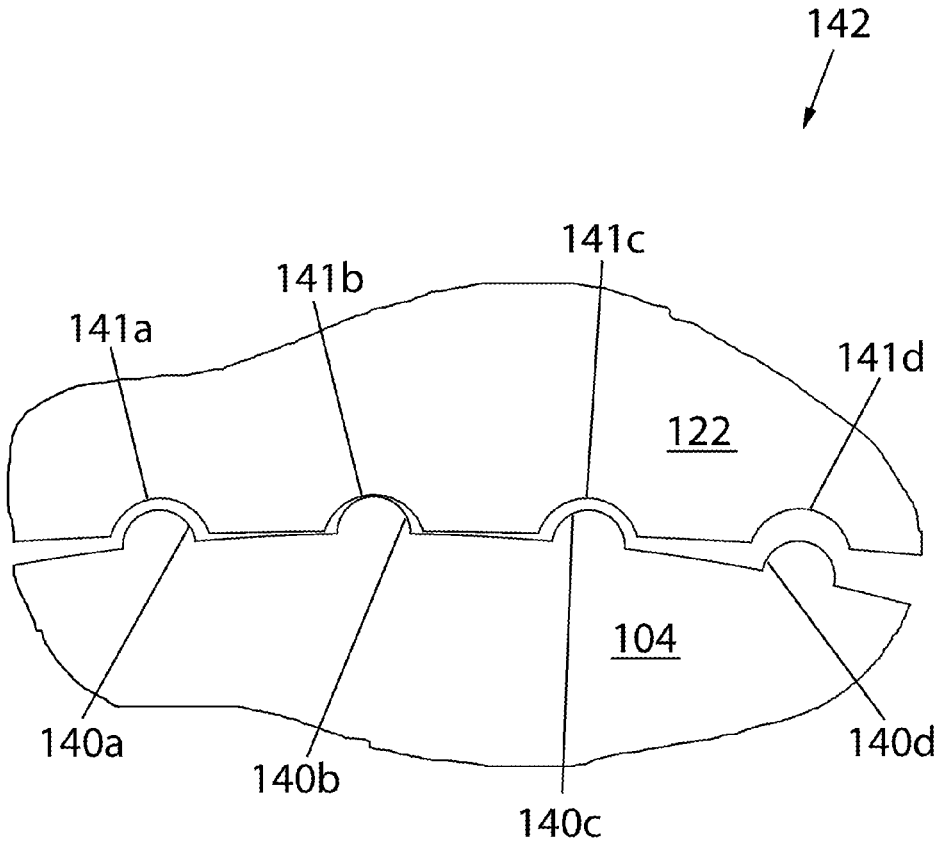
FIG. 14 illustrates a detailed view of timing features on the rigid rings and drive wheels of the apparatus for the display of time of FIG. 12.

FIG. 14 illustrates an interface 142 (the location of the interface 142 is indicated in FIG. 13) between the minute indicator ring 122 and the minute indicator drive wheel 104 of the apparatus 120 of FIGS. 12 and 13. The perspective of FIG. 14 is the same as FIG. 12, i.e., from a point perpendicular to the plane of minute indicator ring 122 and minute indicator drive wheel 104. To ensure that the minute indicator ring 122 and the minute indicator drive wheel 104 remain synchronized, which is useful in maintaining the timekeeping accuracy of the clock assembly 110, the minute indicator ring 122 and the minute indicator drive wheel 104 may have complimentary timing features. The minute indicator drive wheel 104 may have a series (i.e., a plurality) of protrusions along the perimeter of the minute indicator drive wheel 104. Protrusions 140*a* through 140*d* are visible in FIG. 14. Similar protrusions may be uniformly located about the entire perimeter of the minute indicator drive wheel 104.

The minute indicator ring 122 may have a series (i.e., a plurality) of complimentary indentations along the inner annular surface (i.e., the circular surface defined by the through hole through the center of the minute indicator ring 122) of the minute indicator ring 122. Indentations 141*a* through 141*d* are visible in FIG. 14. Similar indentations may be uniformly located along the entirety of the inner annular surface of the minute indicator ring 122. Together, the protrusions and indentations may mesh together as the minute indicator drive wheel 104 is driven and thus maintain synchronized movement between the minute indicator drive wheel 104 and the minute indicator ring 122. The hour indicator drive wheel 103 and the hour indicator ring 121 may be similarly configured. In FIG. 14, protrusion 140*b* and indentation 141*b* are both positioned at a top dead center position.

In this regard, the synchronization features (protrusions and indentations) are on components where one component (e.g., minute indicator ring 122) is entirely supported by the other component (e.g., minute indicator drive wheel 104). This is in contrast to a typical synchronization system such as gears, where the meshing gears are supported by axles through their centers as opposed to one gear providing support for another gear.

Figure 15A:
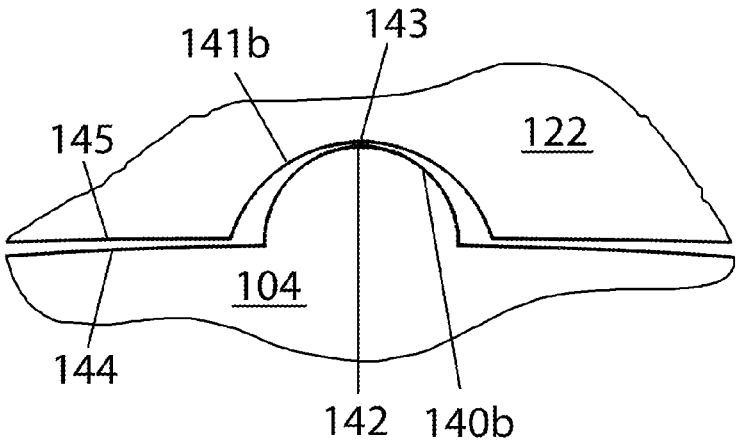
FIG. 15A is a detailed view of one of the timing features of the rigid ring and one of the timing features of the drive wheel of FIG. 14.

FIG. 15A is a close up view of protrusion 140*b* and indentation 141*b* of FIG. 14 at the top dead center position. Together, protrusion 140*b* and indentation 141*b* are configured such that at top dead center, the uppermost portion 142 of protrusion 140*b* is in contact with the uppermost portion 143 indentation 141*b* while substantially no other portion of minute indicator ring 122 is in contact with minute indicator drive wheel 104. Such contact may only be momentary as the minute indicator drive wheel 104 passes through top dead center. After the minute indicator drive wheel 104 passes through top dead center, the minute indicator ring 122 and the minute indicator drive wheel 104 may contact each other in the regions 144, 145 that are between protrusions and indentations. As illustrated, the protrusions and indentations may be uniformly and intermittently located about the minute indicator drive wheel 104 and the minute indicator ring 122. The frequency of such indentation/protrusion pairs may be greater or less than as illustrated.

Both the protrusions and indentations may be arched with the radii of the indentations being larger than the radii of the protrusions. For example, the radii of the indentations may be from 20 to 80 percent larger than the radii of the protrusions. For example, the radii of the indentations may be about 30 percent larger than the radii of the protrusions. In an exemplary embodiment, the radii of the protrusions may be between about 0.015 and 0.040 inches and the radii of the indentations may be between about 0.025 and 0.050 inches. In another exemplary embodiment, the radii of the protrusions may be about 0.025 inches and the radii of the indentations may be about 0.035 inches.

Figure 15B:
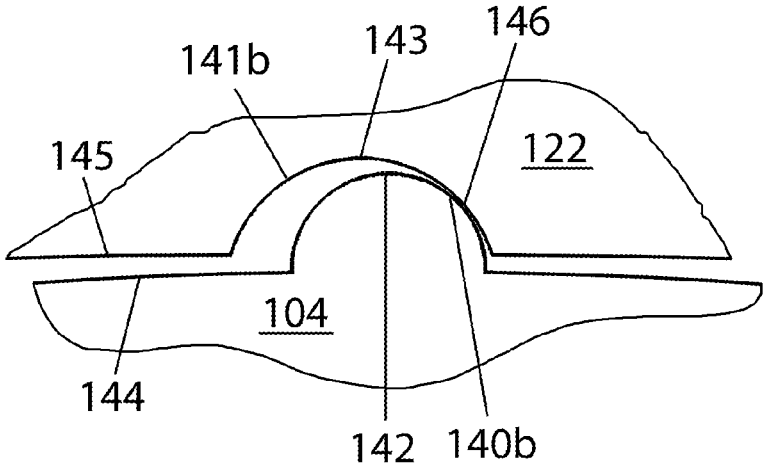
FIG. 15B is a detailed view of the timing feature of FIG. 15A where there is some misalignment between components.

If the minute indicator ring 122 becomes misaligned relative to the minute indicator drive wheel 104, an indentation may be off-center relative to the mating protrusion. Such an event is illustrated in FIG. 15B, which depicts misalignment between protrusion 140*b* and indentation 141*b*. Such misalignment results in contact at point 146 between the protrusion 140*b* and indentation 141*b* along sides of the protrusion 140*b* and indentation 141*b* in such a way that the force of gravity will cause the minute indicator ring 122 to fall down onto the protrusion 140*b* until it settles into position as illustrated in FIG. 15A. In this manner, any misalignment between protrusion 140*b* and indentation 141*b* may be automatically corrected, and therefore synchronized movement of the minute indicator ring 122 relative to the minute indicator drive wheel 104 may be maintained. To assist in the self-alignment of the minute indicator ring 122 relative to the minute indicator drive wheel 104, the contacting surfaces may be adequately smooth to allow such settling into the desired position of FIG. 15A. Additionally, the minute indicator ring 122 and/or the minute indicator drive wheel 104 may include low friction material to allow such settling into the desired position of FIG. 15A. For example, the minute indicator drive wheel 104 (or at least portions thereof) may be constructed from polyoxymethylene, polytetrafluoroethylene, or any other appropriate low friction material.

In a variation from the embodiment shown in FIG. 15A, the protrusion and indentation may be sized such that the protrusion is about as high as the indentation is deep. In such a variation, the regions 144 and 145 may just touch each other when an indentation at top dead center is aligned with a protrusion at top dead center. In another variation, the protrusion and indentation may be sized such that the protrusion is slightly shorter than the indentation is deep. In such a variation, the regions 144 and 145 may touch each other when an indentation at top dead center is aligned with a protrusion at top dead center, while in such a position, the top of the protrusion may not be in contact with the indentation. In each of these variations, the self-aligning aspect of the protrusion-indentation pairs as described with reference to FIG. 15B is present.

FIGS. 15A and 15B illustrate a timing mechanism using particular protrusions and indentations. In another embodiment, the indicator rings may have the protrusions and the indicator drive wheels may have the indentations. In still another embodiment, the indicator rings and indicator drive wheels may each have protrusions and indentations arranged such that protrusions and indentations constantly interact with each other as the indicator drive wheels are rotated. Moreover, other timing mechanisms may be incorporated in addition to or in place of the discussed indentations and protrusions. For example, close control of the outside diameter of the indicator drive wheels and close control of the inner diameters of the indicator rings could eliminate the need for separate timing mechanisms. In another example, the number and spacing of timing features may be varied relative to the illustrations of FIGS. 15A and 15B. For example, in an alternate arrangement, more or fewer pairs of timing features may be used.

Figure 15C:
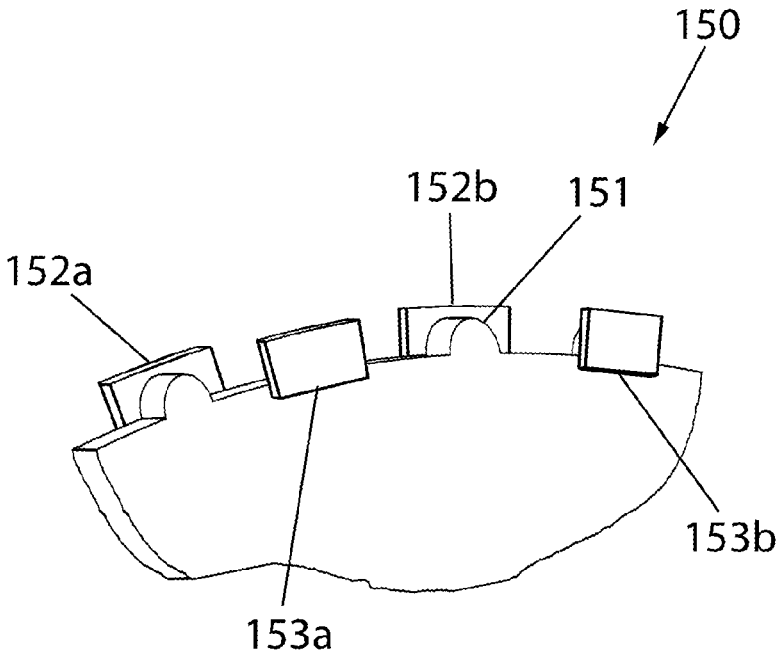
FIG. 15C is a detailed view of a drive wheel featuring the timing features of FIG. 15A and alignment flanges.

As noted above, the various indicator drive wheels may include flanges (e.g., the flanges 16 of FIG. 2) to help to keep the various indicator rings aligned with their respective drive wheels. FIG. 15C illustrates a drive wheel 150 that includes protrusions 151 and castellated portions 152*a*, 152*b* and 153*a*, 153*b*. By alternately positioning castellated portions similar to 152*a* through 152*b* and 153*a* through 153*b* along the entire perimeter of the drive wheel 150, an indicator ring positioned between the castellated portions 152*a* through 152*b* and 153*a* through 153*b* may be maintained in alignment with the drive wheel 150. Moreover, such an arrangement may be unitary and moldable (e.g., injection moldable) using a simple mold without the need for relatively complicated slides.

Although the indicator rings illustrated above all include uniform outer diameters, it is contemplated that alternatively, outer diameters of indicator rings may be non-uniform. For example, the minute indicator 49 of FIG. 5 may extend beyond the outer diameter of the minute indicator ring 48. In other examples, fanciful indicators disposed partially or completely beyond the outer diameter of the indicator rings may be used.

To achieve indicator ring movement such that the indicator rings may indicate a time that may be interpreted using traditional clock interpretation methods, the illustrated movements must have a rotational output greater than a typical movement that directly drives clock hands. For example, where the diameter of a drive wheel is one third of the inner diameter of the indicator ring which it is moving, the rotational speed of such a drive wheel must be three times faster than a normal movement. Thus, if such a drive wheel is being used to drive a minute indicator ring, the drive wheel must rotate at a rate of one full rotation every 20 minutes. Such a rotational speed will result in the minute indicator ring making one full rotation every 60 minutes and thus enable the position of the minute ring to indicate time in a manner that may be interpreted using traditional clock interpretation methods. Various ratios of drive wheel diameter to inner diameter of indicator ring may be utilized along with appropriately configured movements. For example, a ratio of inner diameter of indicator ring to drive wheel diameter of 4:1 may be used with a movement configured to run 4 times faster than a typical movement. Indeed, any appropriate ratio of inner diameter of indicator ring to drive wheel diameter may be used as long as an accompanying appropriately configured movement is used.

Various features may be added to the clocks described herein to increase their functionality (such as the ability to see indicators) and/or aesthetic appeal. For example, where the indicator rings are clear, the indictors disposed on the indicator rings may by one color on one side (e.g., the side visible through the ring where the ring is transparent) and another, different color on the other side. Thus, by selecting which face of the indicator is facing the user (e.g., facing away from a wall), the user may select what color indicator to use. For example, the indicator may be black on one side and white on the other side and the user may thus select a black (e.g., if the clock is to be mounted on a white or light colored wall) indicator or white (e.g., if the clock is to be mounted on a dark colored wall) indicator, thereby enhancing the visual appeal and/or readability of the clock. Similarly, where the indicator rings are opaque, such rings may include indicators of different colors on each side. Moreover, the background color (e.g., the portion of the indicator rings that are not indicators) of the indicator rings may be different on each side of the indicator ring.

In another example of an added feature, a user may be supplied with several different indicators in the form of stickers or other installable members such that a user may select their desired indicator style from a wide array of styles. Such indicators may be removable and replaceable such that a user may change the indicators when desired.

In another example of an added feature, the edges of the indicator rings may be illuminated and light may be directed into the indicators rings (where the indicator rings are transparent) to produce a pleasing aesthetic effect and/or enhance the readability of the clock.

Figure 16:
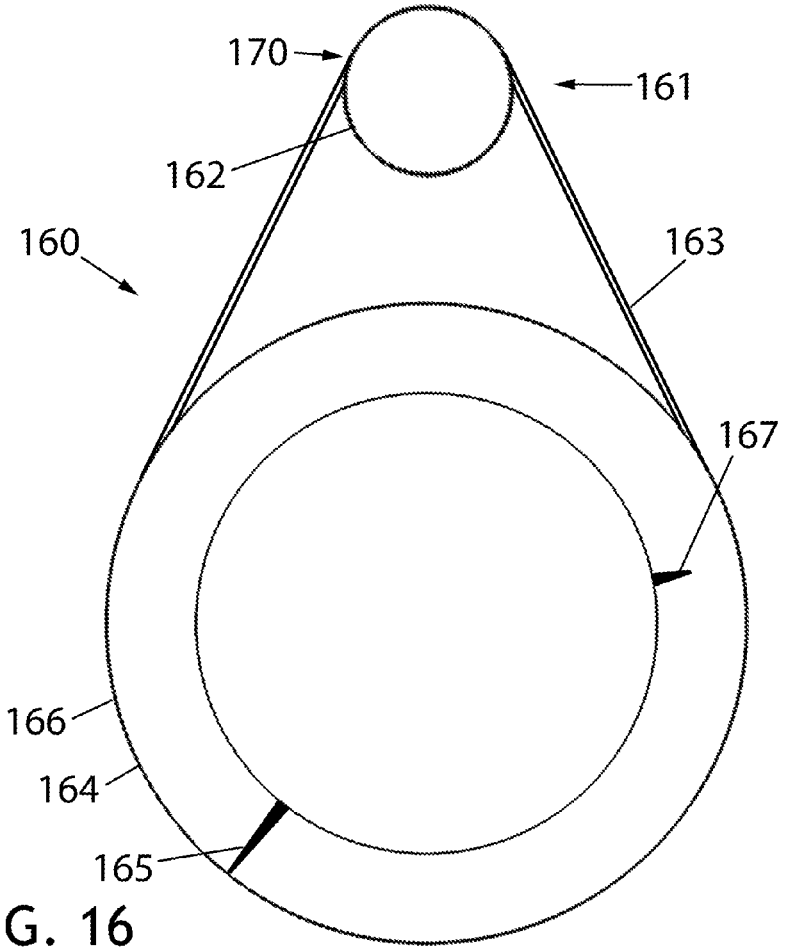
FIG. 16 illustrates an apparatus for the display of time with a movement similar to that of FIG. 11 driving belts which interface with the perimeters of two rigid rings hanging below the movement.
Figure 17:
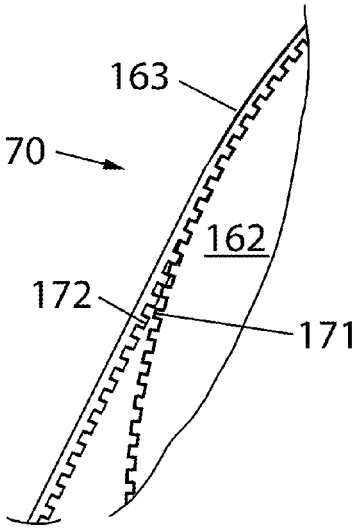
FIG. 17 is a detailed view of the interface between a drive wheel and belt of the apparatus of FIG. 16.

FIGS. 16 and 17 illustrate an apparatus 160 for the display of time that uses a movement 161 similar to that of FIG. 11. The movement 161 includes a minute indicator drive wheel 162 and an hour indicator drive wheel positioned behind the minute indicator drive wheel 162. The hour indicator drive wheel is not visible in FIGS. 16 and 17. The minute indicator drive wheel 162 may drive a minute drive belt 163 which may, in turn, rotate a minute indicator ring 164 that includes a minute indicator 165. The minute drive belt 163 may be positioned about the outer diameter of the minute indicator ring 164 such that movement of the minute drive belt 163 causes the minute indicator ring 164 to rotate. Thus, as illustrated in FIG. 16, the minute drive belt 163 may be partially disposed about a portion of the perimeter of the minute indicator drive wheel 162, and partially disposed about a portion of the perimeter of the minute indicator ring 164.

Similarly, the hour indicator drive wheel may drive an hour drive belt (behind minute drive belt 163 and not visible in FIGS. 16 and 17) which may, in turn, rotate an hour indicator ring 166 that includes an hour indicator 167. The hour drive belt may be positioned about the outer diameter of the hour indicator ring 166 such that movement of the hour drive belt causes the hour indicator ring 166 to rotate. Thus, the hour drive belt may be partially disposed about a portion of the perimeter of the hour indicator drive wheel, and partially disposed about a portion of the perimeter of the hour indicator ring 166.

Accordingly, by using drive belts, the movement 161 may be used to rotate indicator rings 164, 166 that are hanging by the drive belts below the movement 161. Thus, the rings 164, 166 are held in contact with (and therefore can be driven by) their respective belts by the force of gravity. Likewise, the belts are held in contact with (and therefore can be driven by) their respective drive wheels by the force of gravity.

In this regard, the movement 161 may drive the minute indicator ring 164 and hour indicator ring 166 such that the minute indicator ring 164 makes one full rotation every 60 minutes and the hour indicator ring 166 makes one full rotation every 12 hours. Thus, the minute indicator 165 and the hour indicator 167 may indicate the time in a manner that may be interpreted using traditional clock interpretation methods.

In a particular embodiment, the minute indicator ring 164 may have an innermost radius and an outermost radius and the innermost radius of the minute indicator ring 164 may be at least 10 percent as large as the outermost radius. In another embodiment, the innermost radius of the minute indicator ring 164 may be at least 50 percent as large as the outermost radius.

In a particular embodiment, the hour indicator ring 166 may have an innermost radius and an outermost radius and the innermost radius of the hour indicator ring 166 may be at least 10 percent as large as the outermost radius. In another embodiment, the innermost radius of the hour indicator ring 166 may be at least 50 percent as large as the outermost radius.

In a particular embodiment, the minute indicator ring 164 and hour indicator ring 166 may be configured substantially similar to each other except for the indicators 165, 167. In such an embodiment, the minute indicator ring 164 may be transparent such that the hour indicator ring 166 may be visible through the minute indicator ring 164. In such an embodiment, the hour indicator ring 166 may be transparent or opaque. A third stationary ring may be included and positioned behind the minute indicator ring 164 and the hour indicator ring 166. The stationary ring may be sized (e.g., with a larger outer diameter and/or smaller inner diameter) such that it is visible behind the minute indicator ring 164 and the hour indicator ring 166. In embodiments where the hour indicator ring 166 is transparent, the third stationary ring (which may include indicators such as numbers 1 through 12) may be visible through the hour indicator ring 166.

Similar to as described above with reference to driving rings hanging directly on the drive wheels, the diameters of the minute indicator drive wheel 162, the hour indicator drive wheel, the outer diameters of the indicator rings 164, 166, and the output of the movement 161 may all be coordinated to produce movement that may be interpreted using traditional clock interpretation methods. Thus, various rations of drive wheel to indicator diameter may be used with appropriately configured movements. For example, the outer diameter of the minute indicator ring 164 may be four times that of the minute indicator drive wheel 162 and the accompanying movement 161 may be configured to run four times faster than a typical movement. In other embodiments, other ratios (e.g., 3 to 1 and 5 to 1) may be used.

FIG. 17 is a detailed view of a portion 170 (the location of the portion 170 is indicated in FIG. 16) of the interface between the minute indicator drive wheel 162 and the minute drive belt 163. The minute indicator drive wheel 162 may include a series of teeth 171 that interface with a corresponding series of teeth 172 on the minute drive belt 163 to keep the movement of the minute indicator drive wheel 162 and the minute drive belt 163 synchronized. A similar set of teeth may be disposed along the perimeter of the minute indicator ring 164 to keep the movement of the minute indicator ring 164 and the minute drive belt 163 synchronized. Thus, the output of the movement 161 may be synchronized with the movement of the minute indicator ring 164. The hour drive belt, hour indicator drive wheel, and the hour indicator ring 166 may be similarly configured to maintain synchronized movement of the hour indicator ring 166. The minute drive belt 163 may include flanges such that it remains centered relative to the minute indicator drive wheel 162 and minute indicator ring 164. The hour drive belt may be similarly configured.

Figure 18:
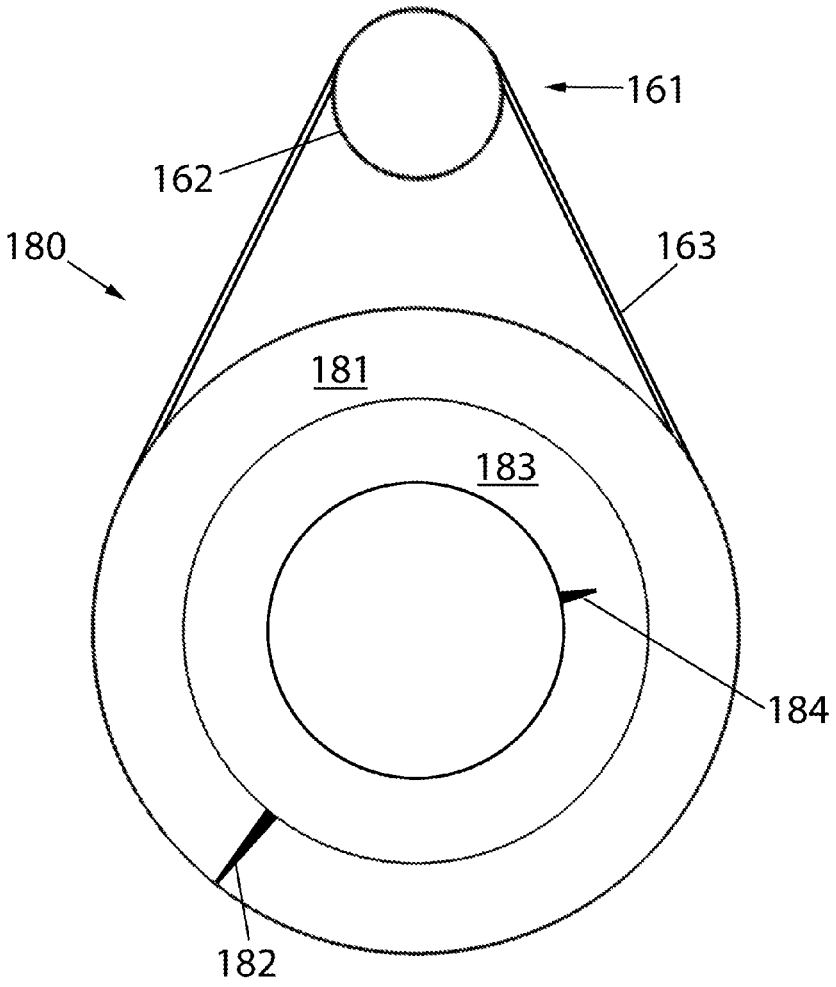
FIG. 18 illustrates an apparatus for the display of time with a movement similar to that of FIG. 16.

FIG. 18 illustrates an apparatus 180 for the display of time that uses the movement 161 and drive belts of the apparatus 160 of FIGS. 16 and 17. The apparatus 180 includes an opaque minute indicator ring 181 and an opaque hour indicator ring 183. The outer diameter of minute indicator ring 181 is substantially the same as the outer diameter of the hour indicator ring 183. The inner diameter of hour indicator ring 183 is smaller than the inner diameter of minute indicator ring 181. Thus, a portion of the hour indicator ring 183 is visible within the through hole of the minute indicator ring 181 and an hour indicator 184 is disposed on such a portion. The minute indicator ring 181 may include a minute indicator 182. In this regard, similar to the apparatus 160 of FIGS. 16 and 17, the indicators 182, 184 may indicate time in such a manner that the apparatus may be read using traditional clock interpretation methods.

In variations of the apparatuses of FIGS. 16 through 18, any of the rings could be replaced with disks (e.g., members with no center through holes). For example, in apparatus 160, the minute indicator ring 164 could be replaced with a transparent disk and the hour indicator ring 166 could be replaced with an opaque disk. Moreover, the inner openings of the rings 164,166, 181, 183 need not be circular. Indeed, the inner openings of the rings 164,166, 181, 183 may contain aesthetic features, such as simulated bicycle wheel spokes and hubs.

Figure 19:
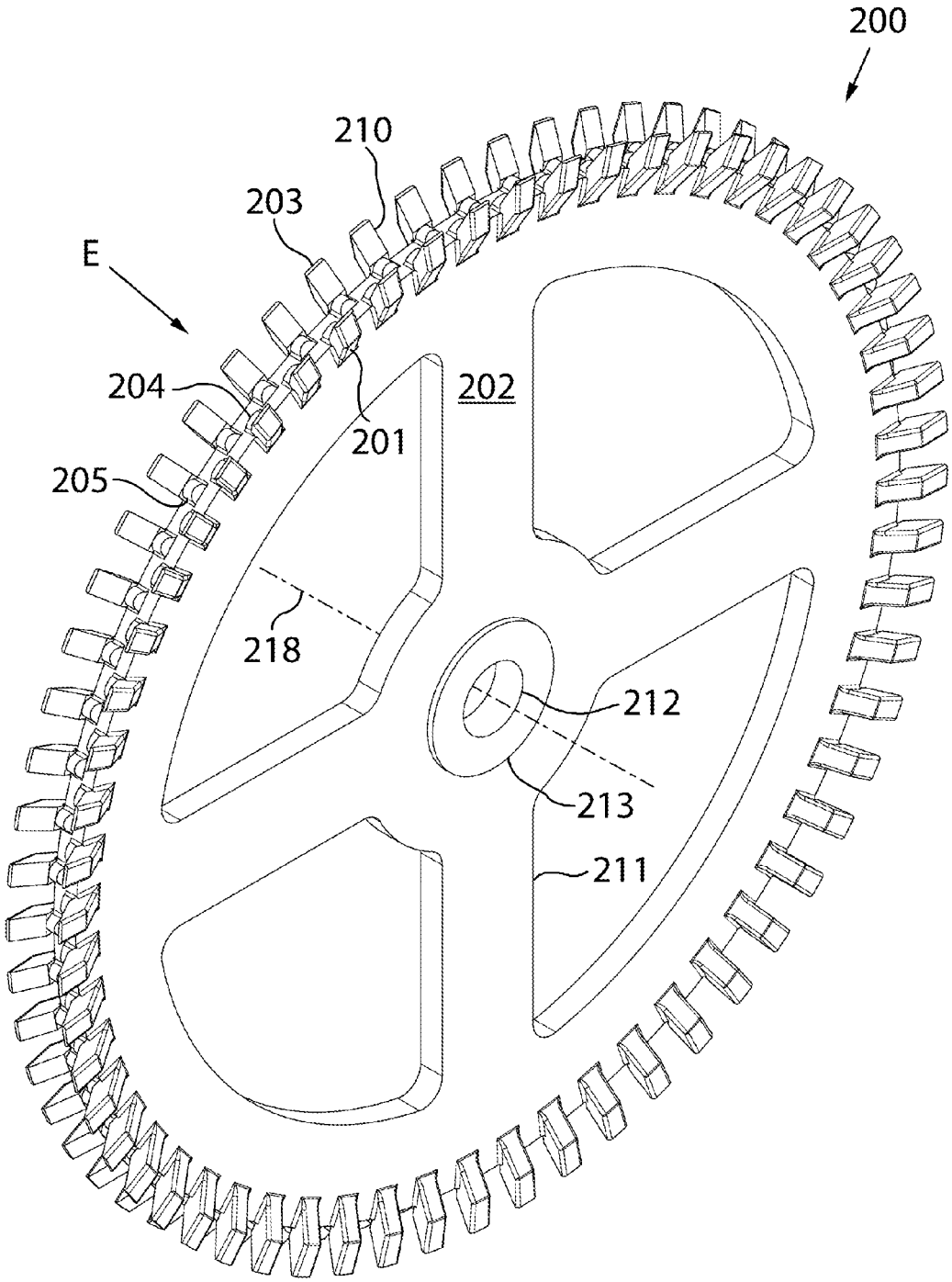
FIG. 19 illustrates an alternate minute indicator drive wheel.

FIG. 19 illustrates a minute indicator drive wheel 200 which is an alternate configuration of the minute indicator drive wheel 104. The minute indicator drive wheel 200 includes a plurality of first side flanges 201 disposed along a first side 202 of the minute indicator drive wheel 200 and a plurality of second side flanges 203 disposed along a second side (opposed to first side 202 and not visible in FIG. 19) of the minute indicator drive wheel 200.

Figure 20:
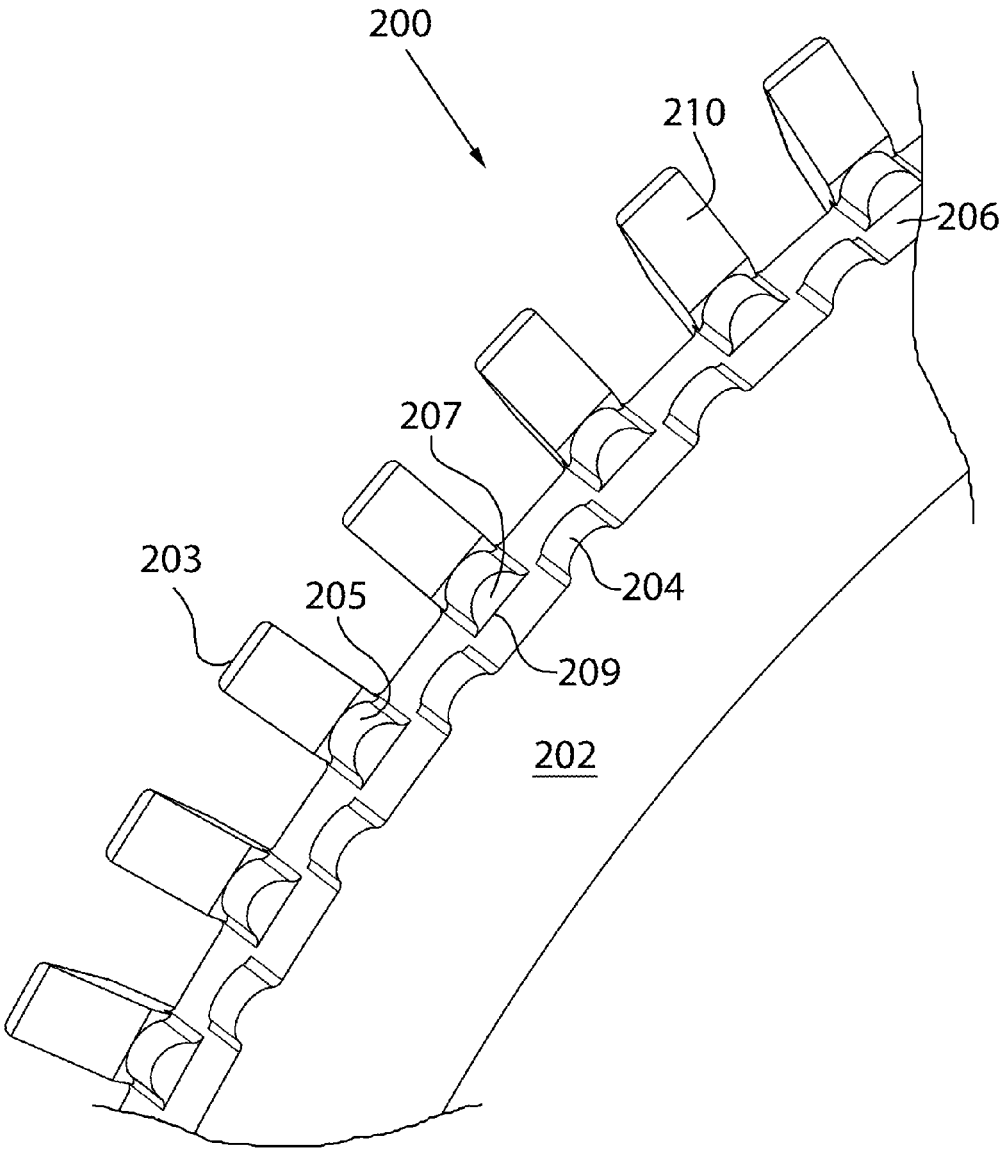
FIG. 20 illustrates a portion of the minute indicator drive wheel of FIG. 19.

FIG. 20 illustrates a portion of the minute indicator drive wheel 200. The portion of the minute indicator drive wheel 200 visible in FIG. 20 is indicated by arrow E in FIG. 19. In FIG. 20, the plurality of first side flanges 201 disposed along the first side 202 of the minute indicator drive wheel 200 are not shown so that a plurality of first side protrusions 204 and a plurality of second side protrusions 205 can be clearly seen. The plurality of first side protrusions 204 may be uniformly located about the entire perimeter of the minute indicator drive wheel 200. The plurality of first side protrusions 204 may be located in a common plane perpendicular to an axis of rotation 218 of the minute indicator drive wheel 200. The plurality of first side protrusions 204 may be configured similarly to the protrusions 140*a* through 140*d* of FIG. 14 except that the plurality of first side protrusions 204 may only extend along a portion of the thickness of an outer annular surface 206 of the minute indicator drive wheel 200. For example, as shown in FIG. 20, the plurality of first side protrusions 204 extend along the outer annular surface 206 from the first side 202 to about a mid-point of the thickness of the outer annular surface 206 half way between the first side 202 and the second side of the minute indicator drive wheel 200.

The plurality of second side protrusions 205 may be configured similar to the plurality of first side protrusions 204, except that the plurality of second side protrusions 205 may extend along the outer annular surface 206 from the second side of the minute indicator drive wheel 200 to about the mid-point of the outer annular surface 206 half way between the first side 202 and the second side of the minute indicator drive wheel 200. The plurality of second side protrusions 205 may be located in a common plane perpendicular to the axis of rotation 218 of the minute indicator drive wheel 200, and the plane in which the plurality of second side protrusions 205 is located may be offset from the plane in which the plurality of first side protrusions 204 is located. Moreover, the plurality of second side protrusions 205 may be circumferentially offset from the plurality of first side protrusions 204 (i.e., as the minute indicator drive wheel 200 is rotated about the axis of rotation 218 protrusions of the plurality of first side protrusions 204 and protrusions of the plurality of second side protrusions 205 alternate occupying the top dead center position). In this manner, the plurality of first side protrusions 204 and the plurality of second side protrusions 205 form alternating protrusions about the entirety of the circumference of the minute indicator drive wheel 200.

FIG. 21 illustrates minute indicator ring 220. The minute indicator ring 220 may be a substantially rigid (i.e., not flaccid) member that is able to maintain its shape when supported by the minute indicator drive wheel 200. The minute indicator ring 220 includes a central through hole 219 through the center of the minute indicator ring 220. The minute indicator ring 220 includes an inner annular surface 221 configured to interface with the minute indicator drive wheel 200. FIG. 22 is a detail view of a portion F (indicated in FIG. 21) of the inner annular surface 221 of the minute indicator ring 220. The inner annular surface 221 may include a plurality of first side indentations 222 and a plurality of second side indentations 223 configured similar to the indentations 141*a* through 141*d* and configured to interface with the plurality of first side protrusions 204 and the plurality of second side protrusions 205, respectively. Thus, the plurality of first side indentations 222 may only extend along a portion of the thickness of the inner annular surface 221. For example, as shown in FIG. 22, the plurality of first side indentations 222 extend along the inner annular surface 221 from a first side of the minute indicator ring 220 to about a mid-point of the thickness of the inner annular surface 221. The plurality of second side indentations 223 is similarly configured and circumferentially offset from the plurality of first side indentations 222 in a manner similar to the offset between protrusions 204, 205 of the minute indicator drive wheel 200.

As illustrated, the plurality of first side protrusions 204 includes sixty individual protrusions uniformly disposed along the perimeter of the minute indicator drive wheel 200 such that the protrusion are six degrees apart from each other. Similarly, the plurality of second side protrusions 205 includes sixty individual protrusions uniformly disposed along the perimeter of the minute indicator drive wheel 200 such that the protrusion are six degrees apart from each other. The plurality of first side protrusions 204 and the plurality of second side protrusions 205 are offset from each other such that there is a protrusion every three degrees along the perimeter of the minute indicator drive wheel 200. Correspondingly, the plurality of first side indentations 222 of the minute indicator ring 220 includes 120 individual indentations uniformly disposed along the inner annular surface 221 such that the indentations are two degrees apart from each other. The plurality of second side indentations 223 of the minute indicator ring 220 includes 120 individual indentations uniformly disposed along the inner annular surface 221 such that the indentations are two degrees apart from each other. Thus as the minute indicator drive wheel 200 rotates at a first rate (e.g., three rotation every hour), the minute indicator ring 220 hanging on the minute indicator drive wheel 200 will rotate at a second rate (e.g., one rotation every hour) that is one third of the first rate.

The two sets of protrusions 204, 205 and the two sets of indentations 222, 223 work together to maintain synchronization in the same manner as described with respect to protrusions 140*a* through 140*d* and indentations 141*a* through 141*d*. Additionally, the two sets of protrusions 204, 205 and the two sets of indentations 222, 223 work together to maintain alignment between the minute indicator drive wheel 200 and the minute indicator ring 220. This is achieved through the interaction between the inboard sides of the protrusions 204,205, such as inboard side 207 (FIG. 20), and the inboard walls of the indentations, such as inboard wall 208 (FIG. 22). When the minute indicator ring 220 is interfaced with the minute indicator drive wheel 200, a plurality of protrusions 204, 205 and indentations 222, 223 will be engaged with each other. Additionally, a plurality of inboard sides of the protrusions 204, 205 will be proximate to a plurality of inboard walls of the indentations 222, 223. The interaction between the inboard sides of the protrusions 204, 205 and the inboard walls of the indentations 222, 223 will serve to keep the minute indicator ring 220 aligned with the minute indicator drive wheel 200. For example, the inboard sides of the plurality of second side protrusions 205 (such as inboard side 207) will interface with the inboard walls of the plurality of second side indentations 223 (the second side indentation 223 inboard walls are not visible in FIG. 22) to prevent the minute indicator ring 220 from moving relative to the minute indicator drive wheel 200 in the direction of the plurality of second side flanges 203.

The inboard sides of the plurality of second side protrusions 205 (such as inboard side 207) may have a draft angle to help prevent binding between the minute indicator ring 220 and the minute indicator drive wheel 200. For example, from a base 209 of the inboard side 207, the inboard side 207 may be angled such that the protrusion is wider (in the direction across the outer annular surface 206) at its base 209 than at its top. The draft angle is disposed such that a portion of the inboard walls of the indentations 222, 223 in contact with the draft angle will slide down to a bottom of the draft angle (e.g., base 209) and thus cause the minute indicator ring 220 to be in alignment with the minute indicator drive wheel 200. Alternatively, the inboard walls of the indentations may include a draft angle in place of or in addition to the draft angles of the plurality of second side protrusions 205.

The two sets of indentations 222, 223 combine to give the appearance of a smooth inner diameter of the minute indicator drive wheel 200. This is since each indentation is bordered by an inboard wall and the tops of the inboard walls form a uniform appearance to the inner diameter of the minute indicator drive wheel 200.

The plurality of first side flanges 201 and the plurality of second side flanges 203 (FIG. 19) assist a user in initial alignment between the minute indicator drive wheel 200 and the minute indicator ring 220. In this regard, a user attempting to hang the minute indicator ring 220 on the minute indicator drive wheel 200 need only locate the minute indicator ring 220 between the plurality of first side flanges 201 and the plurality of second side flanges 203. Once so positioned, the minute indicator ring 220 can be released and it will slide down inner sloped surfaces 210 of the plurality of first side flanges 201 and the plurality of second side flanges 203 until the plurality of protrusions 204, 205 and indentations 222, 223 are in contact with each other. Subsequent rotation of the minute indicator drive wheel 200 will lead to the plurality of protrusions 204, 205 and indentations 222, 223 engaging each other and alignment between the minute indicator drive wheel 200 and the minute indicator ring 220.

The plurality of first side flanges 201 and the plurality of second side flanges 203 may also assist in realigning the minute indicator drive wheel 200 and the minute indicator ring 220 if the minute indicator drive wheel 200 and the minute indicator ring 220 somehow become misaligned relative to each other. Such misalignment may be the result of a bumping of the minute indicator ring 220 or if an air current displaced the minute indicator ring 220.

As illustrated in FIG. 19, the plurality of first side flanges 201 and the plurality of second side flanges 203 may be castellated and alternating such that the minute indicator drive wheel 200 may be molded without the use of slides or other complicated mechanisms. Alternatively, continuous flanges may be used in place of the plurality of first side flanges 201 and the plurality of second side flanges 203. Such flanges may be separate parts that are subsequently attached to the indicator drive wheel 200 or they may be integral with the indicator drive wheel 200. Other appropriate configurations, and associated processes, of the flanges may be incorporated into the indicator drive wheel 200.

In an exemplary configuration: the diameter of the outer annular surface 206 of the minute indicator drive wheel 200 may be 2.725 inches while the inner annular surface 221 of the minute indicator ring 220 may be 8.175 inches (a 3:1 ratio); the minute indicator ring 220 may be 0.062" thick; and the distance between the bases of the plurality of first side flanges 201 and the plurality of second side flanges 203 may be about 0.072". By having the distance between the bases of the plurality of first side flanges 201 and the plurality of second side flanges 203 larger than the thickness of the minute indicator ring 220, binding between the minute indicator ring 220 and the minute indicator drive wheel 200 may be avoided. In the exemplary configuration, the distance between the tops of the plurality of first side flanges 201 and the plurality of second side flanges 203 may be 0.17". The aforementioned dimension of the exemplary configuration may be varied to achieve specific aesthetic or functional goals. Other ratios of the diameters of the outer annular surface 206 of the minute indicator drive wheel 200 to the inner annular surface 221 of the minute indicator ring 220 may be used with corresponding changes to the movement used to drive such a configuration.

FIGS. 19 through 22 show minute indicator drive wheel 200 and minute indicator ring 220. In a particular clock, a corresponding hour indicator drive wheel and hour indicator ring may be similarly configured. Such an hour indicator drive wheel may only differ from minute indicator drive wheel 200 in that a mounting hole 212 of the minute indicator drive wheel 200 may be configured to fix to a minute output shaft while a mounting hole of the hour indicator drive wheel may be configured to fix to an hour output shaft. Such an hour indicator ring may only differ from minute indicator ring 220 in that the minute indicator ring 220 may include a minute indicator 244, while the hour indicator ring may include an hour indicator.

Figure 23:
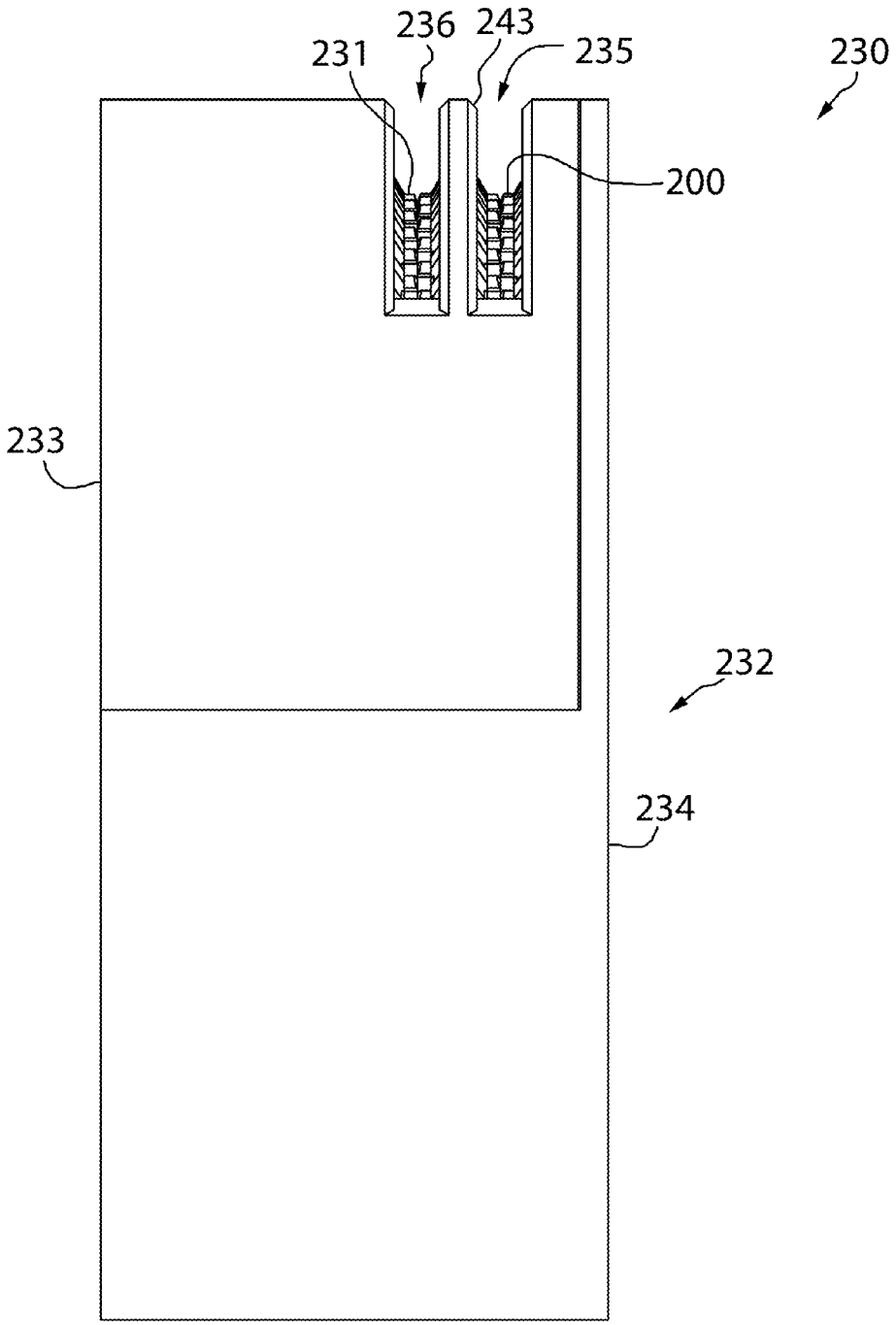
FIG. 23 is a side view of an assembled clock drive portion.

FIG. 23 is a side view of an assembled clock drive portion 230 that includes minute indicator drive wheel 200 and a similarly configured hour indicator drive wheel 231. A clock movement that drives the minute indicator drive wheel 200 and the hour indicator drive wheel 231 is disposed within a cover 232. The cover 232 comprises a top half cover 233 and a bottom half cover 234. The top half cover 233 includes a minute ring clearance slot 235 and an hour ring clearance slot 236. The edges of the ring clearance slots 235, 236 may include chamfers 243 to further assist in placement of the minute indicator ring 220 and an hour indicator ring. The minute ring clearance slot 235 may be sized such that if the minute indicator ring 220 enters into the slot 235, the minute indicator ring 220 will be positioned between the flanges 201, 203 of the minute indicator drive wheel 200 disposed therein. Thus, a user need only position the minute indicator drive wheel 200 within the minute ring clearance slot 235 and the minute indicator ring 220 will align with the minute indicator drive wheel 200. Once the minute indicator ring 220 is aligned with the minute indicator drive wheel 200, the minute indicator ring 220 will not touch the sides of the minute ring clearance slot 235 unless the minute indicator ring 220 is disturbed (e.g., bumped, repositioned to change setting of clock).

The hour ring clearance slot 236, hour indicator ring and hour indicator drive wheel may be configured similarly to the minute ring clearance slot 235, minute indicator ring 220, and the minute indicator drive wheel 200, respectively.

FIGS. 19 through 23 and related discussion illustrate a timing mechanism using particular protrusions and indentations. In a variation, illustrated in corresponding FIGS. 26 through 30, the indicator rings, such as a minute indicator ring 320, may have protrusions 322, 323 and the indicator drive wheels, such as a minute indicator drive wheel 300, may have indentations 304, 305. In still another embodiment, the indicator rings and indicator drive wheels may each have protrusions and indentations arranged such that protrusions and indentations constantly interact with each other as the indicator drive wheels are rotated. Moreover, other timing mechanisms may be incorporated in addition to or in place of the discussed indentations and protrusions.

Figure 24:
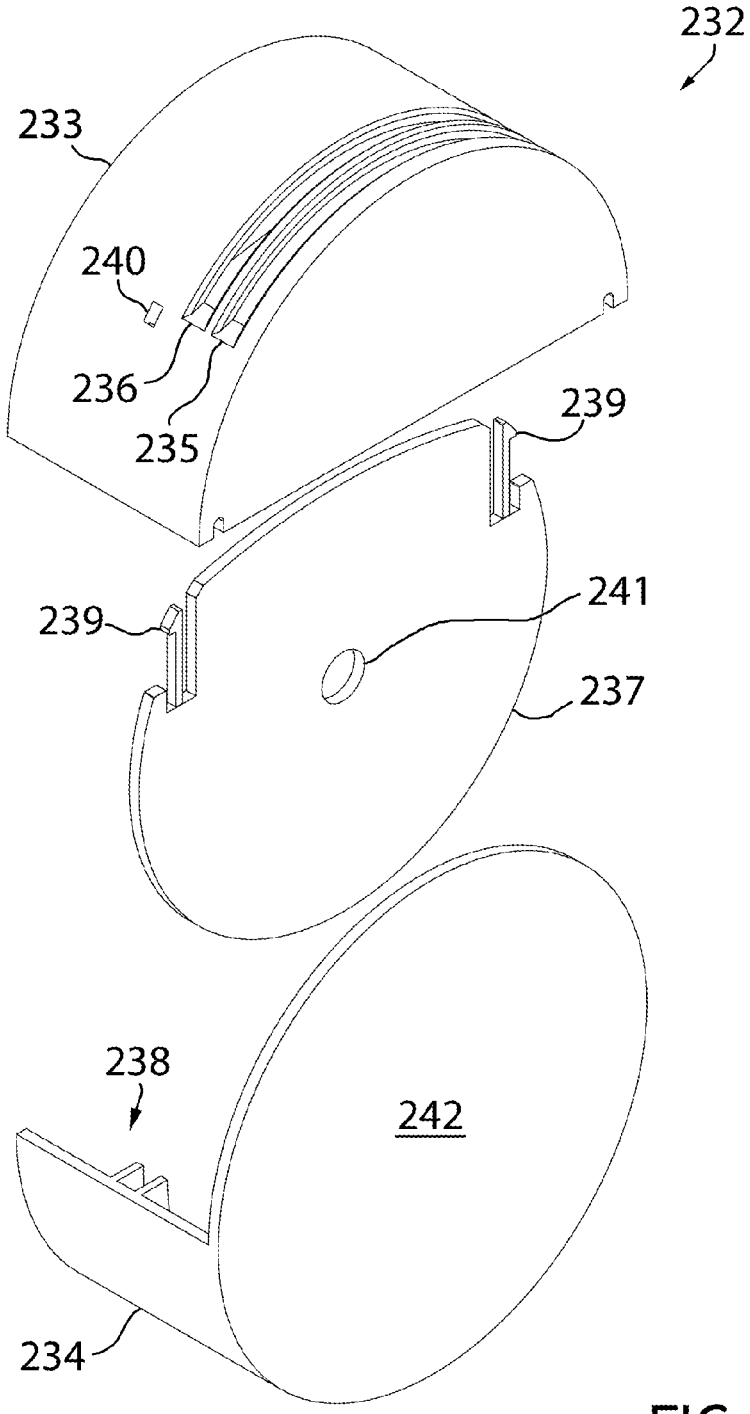
FIG. 24 is a partial exploded view of the clock drive portion of FIG. 23.

FIG. 24 shows the cover 232 exploded, revealing a mounting plate 237 disposed within the cover 232. The top half cover 233 and bottom half cover 234 may each have slot features 238 and may position the mounting plate 237 within the slot features 238 when the top half cover 233 is attached to the bottom half cover 234. The mounting plate may also have snaps 239 that interface with corresponding holes 240 in the top half cover 233 such that the mounting plate 237 may be easily secured to the top half cover 233. The bottom half cover 234 may then be secured to the top half cover 233 using any appropriate method, such as screws or snaps.

The bottom half cover 234 includes a circular region 242 positioned at the front of the clock drive portion 230. The circular region 242 presents a smooth, unbroken surface to observers of the clock drive portion 230. In an alternative construction, the bottom half cover 234 and the top half cover 233 may together form the front surface of the clock drive portion 230. In such a case, a witness line between the bottom half cover 234 and the top half cover 233 on the front of the clock drive portion 230 may be visible.

The back of the clock drive portion 230 may be at least partially open to allow access to a battery driving the movement. By configuring the bottom half cover 234, the top half cover 233, and the mounting plate as shown in FIG. 24, each part may be capable of being molded using a mold without the use of slides or other complicated mechanisms. In a variation, top half cover 233 and the mounting plate 237 may be molded as a single unitary part. In such a variation, the snaps 239 and corresponding holes 240 would not be present.

Returning to FIG. 19, the minute indicator drive wheel 200 may include a plurality of lightening holes 211. The addition of the lightening holes 211 may reduce the weight of the minute indicator drive wheel 200 without unacceptably reducing the structural integrity of the minute indicator drive wheel 200. The minute indicator drive wheel 200 may include the mounting hole 212 through its center. The mounting hole 212 may be configured to press on to a minute output shaft of a movement. Alternatively, the mounting hole 212 may be a threaded hole configured to screw onto a correspondingly configured minute output shaft of a movement. Other appropriate configurations of the mounting hole 212 may be utilized. For example, the mounting hole 212 may include a pressed-in nut or other fastener to secure the minute indicator drive wheel 200 to a minute output shaft of a movement. An hour indicator drive wheel may be similarly configured for securement onto an hour shaft of a movement.

The minute indicator drive wheel 200 may include a boss 213 disposed about the mounting hole 212 on one side of the minute indicator drive wheel 200. The output shafts of movements often have multiple sections with different diameters. Where the different diameters meet, a step is formed that is intended to provide a stop for a clock hand being pressed onto the output shaft. In a particular application, the minute indicator drive wheel 200 may be pressed onto a minute output shaft of a movement until the minute indicator drive wheel 200 comes in contact with a step of the minute output shaft. In this regard, pressing the minute indicator drive wheel 200 until it hits such a stop provides for consistent positioning of the minute indicator drive wheel 200. Thus, alignment with other components, such as the minute ring clearance slot 235 of FIG. 23 may be achieved. The boss 213 may be positioned on only one side of the minute indicator drive wheel 200 so that when assembling the clock drive portion 230, one of two possible positions may be selected depending on whether the side of the minute indicator drive wheel 200 with the boss is facing the movement or the side of the minute indicator drive wheel 200 without the boss 213 is facing the movement. In a particular example, an hour indicator drive wheel may be placed on an hour output shaft with the side of the hour indicator drive wheel without the boss facing the movement and the minute indicator drive wheel 200 may be placed on a minute output shaft with the side of the minute indicator drive wheel 200 with the boss facing the movement; thus resulting in extra separation of the hour indicator drive wheel and the minute indicator drive wheel 200 equal to the height of the boss that would not be present if no boss 213 were on the drive wheels or if the bosses of each drive wheel were facing the same direction.

A method of assembling the clock drive portion 230 of FIG. 23 will now be described. A first step may be to attach a movement (such as movement 90) to the mounting plate 237 by inserting the mounting bushing of the movement through the mounting hole 241 of the mounting plate 237 and then installing a nut (such as nut 124) onto the mounting bushing and tightening the nut to secure the movement and mounting plate 237 to each other. This first step may include placing one or more washers or spacers between the movement and the mounting plate 237 such that the output shafts of the movement are properly positioned relative to the mounting plate 237. This first step may include placing one or more washers or spacers between the nut and the mounting plate 237 such that the nut is properly positioned relative to an hour output shaft of the movement.

A second step in the assembly process may be to push a support bushing (such as support bushing 100) over the nut such that the support bushing is fixed to the nut and a portion of the support bushing is disposed to support a portion of the hour output shaft that is located distal to an end of the mounting bushing. A third step may be to install the hour indicator drive wheel 231 onto the hour output shaft. This may be achieved by pressing the hour indicator drive wheel 231 onto a first portion of the hour output shaft until the hour indicator drive wheel 231 comes into contact with a second portion of the hour output shaft that has a larger diameter than the first portion of the hour output shaft.

The next step may be to install the minute indicator drive wheel 200 onto a minute output shaft of the movement. This may be achieved by pressing the minute indicator drive wheel 200 onto a first portion of the minute output shaft until the minute indicator drive wheel 200 comes into contact with a second portion of the minute output shaft that has a larger diameter than the first portion of the minute output shaft The next step may be to attach the mounting plate 237 to either the top half cover 233 or the bottom half cover 234. For example, as illustrated in FIG. 24, the mounting plate 237 may be operable to snap onto the top half cover 233. Next, the other of the top half cover 233 or the bottom half cover 234 may be installed. For example, as illustrated in FIG. 24, the bottom half cover 234 may be attached to the mounting plate 237/top half cover 233 to complete the assembly of the clock drive portion of FIG. 23. This may be achieved by any appropriate means such as, but not limited to, snaps, screws, and/or clips.

To install a clock using the clock drive portion 230, a user need only install a battery into the movement (unless a battery is already installed), place the clock drive portion in a desired location (such as hanging on a wall or attached to a support structure), position an hour indicator ring within the hour ring clearance slot 236 with the indicator of the hour indicator ring in the proper position to reflect the current hour of the day (using traditional clock interpretation methods), and position a minute indicator ring within the minute ring clearance slot 235 with the indicator of the minute indicator ring in the proper position to reflect the current minute of the hour (using traditional clock interpretation methods).

A method of indicating the current time using the clock drive portion 230 and FIGS. 19 through 23 will now be described. The method may include driving the hour indicator drive wheel 231 at a first rotational rate about the axis of rotation 218. With the hour indicator ring (similar to minute indicator ring 220) hanging on the hour indicator drive wheel 231, the method may include rotating the hour indicator drive wheel 231 which results in the hour indicator ring being driven at a second rotational rate about a second axis that is offset from the axis of rotation 218. The hour indicator ring may be driven such that it completes one rotation every twelve hours and, as such, an indicator affixed to the hour indicator ring may be used to indicate the hour of the day using traditional clock interpretation methods. The contact between the hour indicator drive wheel 231 and the hour indicator ring may be maintained by the force of gravity acting on the hour indicator ring. The hour indicator drive wheel 231 may be disposed within a central through hole in the center of the hour indicator ring. The method may include maintaining synchronization between the hour indicator drive wheel 231 and the hour indicator ring by sequentially engaging a plurality of protrusions (similar to protrusions 204, 205 of minute indicator drive wheel 200) with a plurality of indentations (similar to indentations 222, 223 of minute indicator ring 220).

The method may further include driving the minute indicator drive wheel 200 at a third rotational rate about the axis of rotation 218. With the minute indicator ring 220 hanging on the minute indicator drive wheel 200, the method may further include rotating the minute indicator drive wheel 200 which results in the minute indicator ring 220 being driven at a fourth rotational rate about the second axis. The minute indicator ring 220 may be driven such that it completes one rotation every hour and, as such, the minute indicator 244 affixed to the minute indicator ring 220 may be used to indicate the minute of the hour using traditional clock interpretation methods. The contact between the minute indicator drive wheel 200 and the minute indicator ring 220 may be maintained by the force of gravity acting on the minute indicator ring 200. The minute indicator drive wheel 200 may be disposed within the central through hole 219 in the center of the minute indicator ring 220. The method may include maintaining synchronization between the minute indicator drive wheel 200 and the minute indicator ring 220 by sequentially engaging the plurality of protrusions 204, 205 with the plurality of indentations 222, 223.

Figure 25:
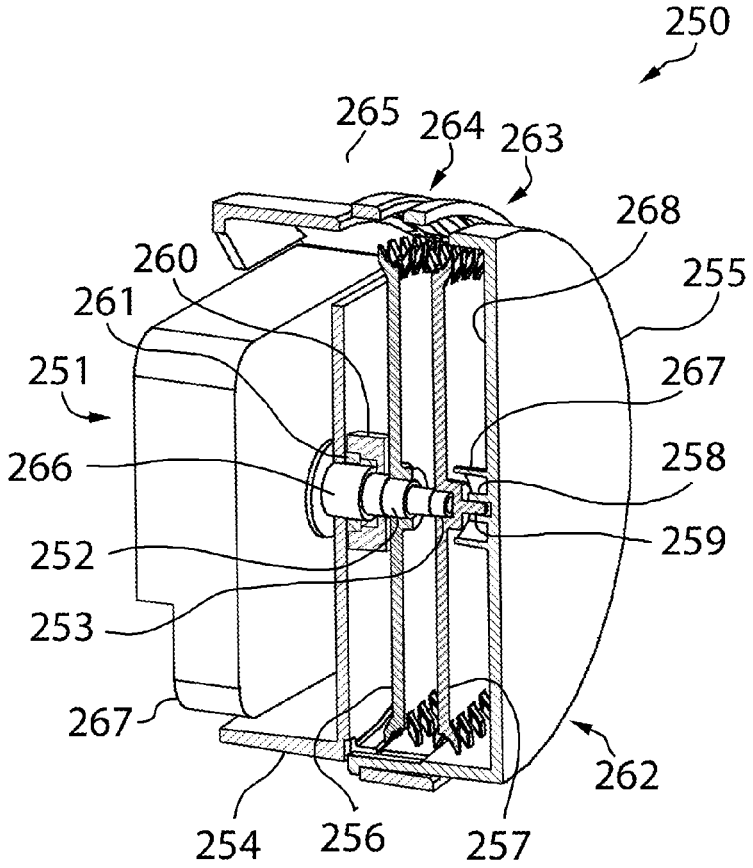
FIG. 25 is a partially sectioned view of an assembled clock drive portion that includes a movement, a minute indicator drive wheel, and an hour indicator drive wheel.
Figure 26:
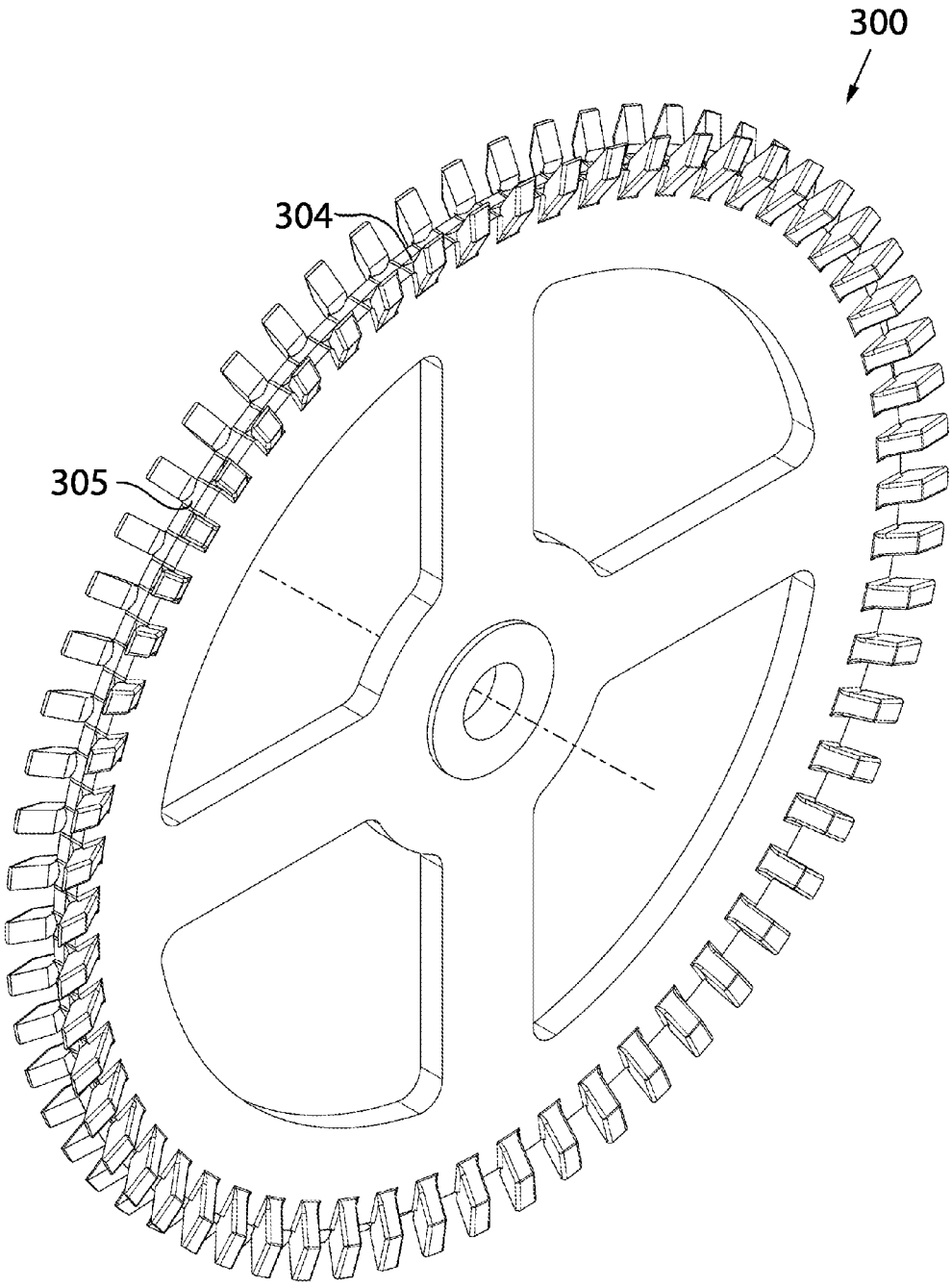
FIG. 26 illustrates another alternate minute indicator drive wheel.
Figure 27:
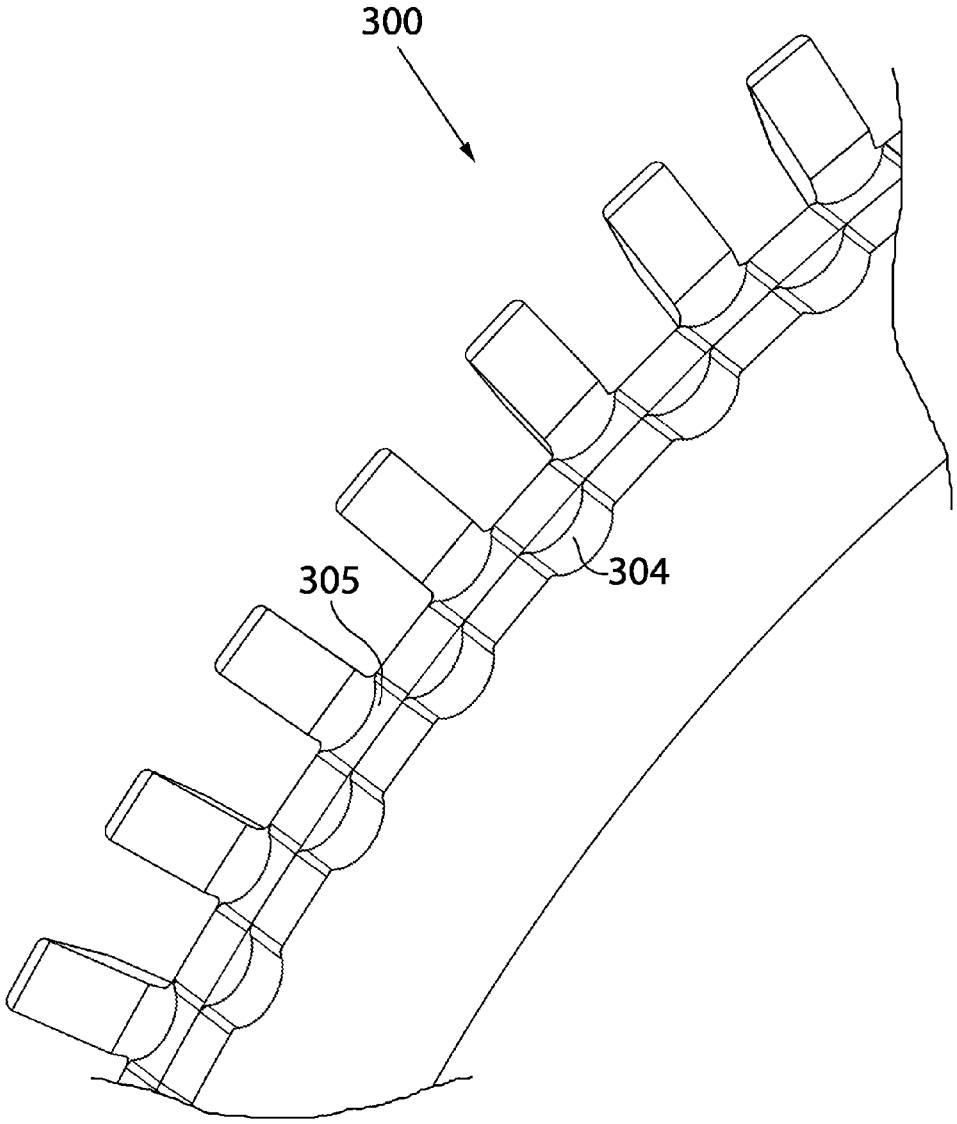
FIG. 27 illustrates a portion of the minute indicator drive wheel of FIG. 26.

FIG. 25 is a partially sectioned side view of an assembled clock drive portion 250 that includes a clock movement 251 (not sectioned), a minute indicator drive wheel 257 (sectioned), and a similarly configured hour indicator drive wheel 256 (sectioned). The clock movement 251 that drives the minute indicator drive wheel 257 and the hour indicator drive wheel 256 is disposed within a cover 262 (sectioned) that comprises a movement cover portion 254 (sectioned) and a front cover portion 255 (sectioned). The movement cover portion 254 and the front cover portion 255 may snap together to form the cover 262. The front cover portion 255 includes a minute ring clearance slot 263. The movement cover portion 254 includes a stationary ring clearance slot 265. Together, the front cover portion 255 and the movement cover portion 254 form an hour ring clearance slot 264, with the front cover portion 255 forming the front portion of the hour ring clearance slot 264 and the movement cover portion 254 forming the rear portion of the hour ring clearance slot 264. Thus, the three ring clearance slots 263, 264, 265 may be formed by two parts: the front cover portion 255 and the movement cover portion 254.

The edges of the ring clearance slots 263, 264, 265 may include chamfers to further assist in placement of rings. The minute ring clearance slot 263 may be sized such that if the minute indicator ring enters into the slot 263, the minute indicator ring will be positioned between flanges of the minute indicator drive wheel 257 disposed therein. The hour ring clearance slot 264, hour indicator ring and hour indicator drive wheel 256 may be configured similarly to the minute ring clearance slot 263, minute indicator ring, and the minute indicator drive wheel 257, respectively.

The movement 251 may include a body portion 267. External to the body portion 267, the movement 251 may further include a mounting bushing 266, an hour output shaft 252, and a minute output shaft 253. The minute output shaft 253 may be disposed within, and be coaxial with, the hour output shaft 252. As illustrated, the hour output shaft 252 may extend beyond a distal end of the mounting bushing 266.

A support bushing 260 (sectioned) may be configured to fixedly attach to the mounting bushing 266 by attaching to a nut 261(sectioned) that is in turn attached to the support bushing 260. The support bushing 260 may provide support for the hour output shaft 252 proximate to the distal end of the mounting bushing 266. This is similar to the support bushing 100 described above with reference to FIGS. 9 through 11.

The minute indicator drive wheel 257 may include a shaft portion 259 that extends distally beyond the end of the minute output shaft 253 and along the rotational axis of the minute output shaft 253. The front cover portion 255 may include a corresponding hole 258 configured to accept the shaft portion 259 when the clock drive portion 250 is fully assembled as illustrated in FIG. 25. The hole 258 may provide a bearing surface for the shaft portion 259 such that when a downward (as oriented in FIG. 25) force is exerted on the minute indicator drive wheel 257 (such as by the insertion of a minute indicator ring into the minute ring clearance slot 263), the downward force is at least partially borne by the internal surface of the hole 258 and thus by the front cover portion 255. Accordingly, at least a portion of the downward force may not be transmitted to the minute output shaft 253. In this regard, the combination of the hole 258 and shaft portion may prevent the minute output shaft 253 from being cantilevered; i.e., cantilevered with one end being supported within the body portion 267 of the movement 251 while the unsupported distal end is subjected to the downward force of the minute indicator ring.

The minute output shaft 253 may provide a bearing surface for the hour indicator drive wheel 256. Thus, similar to minute indicator drive wheel 257, the hour indicator drive wheel 256 may be supported externally to the body portion 267: by the support bushing 260 and by the bearing surface provided by the minute output shaft 253. Thus, when a downward (as oriented in FIG. 25) force is exerted on the hour indicator drive wheel 256 (such as by the insertion of an hour indicator ring into the hour ring clearance slot 264), the combination of the support bushing 260 and minute output shaft 253 may prevent the hour output shaft 252 from being cantilevered; i.e., cantilevered with one end being supported within the body portion 267 of the movement 251 while the unsupported distal end is subjected to the downward force of the minute indicator ring.

In this regard, the above combination of the support bushing 260 and hole 258 provide points of support on both sides of the indicator drive wheels 256, 257 and thus may reduce the amount of force transmitted to the internal workings of the movement 251 due to the weight of installed hour and minute indicator rings.

The interface between the hole 258 and shaft portion 259 may be lubricated and/or at least the hole 258 and/or shaft portion 259 may be comprise a lubricious material.

The front cover portion 255 may include a dust ring 267 that may extend from an inner surface 268 of the front cover portion 255 and around the area where the shaft portion 259 interfaces with the hole 258. The dust ring 267 may be in the form of a circular wall surrounding the interface between the front cover portion 255 and the shaft portion 259 such that any dust falling into the interior of the front cover portion 255 may be inhibited from reaching the interface between the front cover portion 255 and the shaft portion 259, thus potentially increasing the service life of the clock drive portion 250.

The various parts described herein may be constructed using any appropriate means. For example, the parts that may be constructed from polymers and/or may be configured such that they may be constructed using a molding process such as injection molding.

The various indicator rings illustrated herein generally have an inner diameter (e.g., the diameter of the hole through the indicator ring) that is at least about 70% as large its outer diameter. In other examples, the ratio of inner diameter to outer diameter may be varied to produce differing aesthetic effects. For example, the ratio may be lower (e.g., from 70% to 50% or lower) or higher (e.g., from 70% to 90% or higher).

While various embodiments have been described in detail, it is apparent that further modifications and adaptations of the invention will occur to those skilled in the art. However, it is to be expressly understood that such modifications and adaptations are within the spirit and scope of the present invention.

What is claimed is:

1. A clock comprising:

(a) a clock movement comprising:

a case;

a battery compartment configured to interconnect to a battery;

a motor disposed within said case;

a gear train;

a mounting bushing, wherein said mounting bushing is an elongated tubular member, wherein said mounting bushing comprises a proximal end and a distal end, wherein said proximal end of said mounting bushing is fixed to said case;

an inner output shaft, wherein said inner output shaft is driven at a first angular rate by said motor;

an outer output shaft, wherein said outer output shaft is driven at a second angular rate by said motor, wherein said first angular rate is different than said second angular rate, wherein said inner shaft and said outer shaft are coaxial, wherein said inner shaft is at least partially disposed within said outer shaft, wherein said outer shaft and said mounting bushing are coaxial along an axis of rotation, wherein said outer shaft is at least partially disposed within said mounting bushing; and a support bushing, wherein said support bushing is fixed relative to said distal end of said mounting bushing, wherein a bearing portion of said support bushing is positioned distal to said mounting bushing, wherein said bearing portion of said support bushing includes an annular bearing surface surrounding a bearing portion of said outer output shaft, wherein no portion of said clock movement is disposed between said annular bearing surface and said bearing portion of said outer output shaft;

(b) first and second drive wheels, said first drive wheel is fixed to said outer output shaft and said second drive wheel is fixed to said inner output shaft;

(c) a first rigid ring comprising a first inner annular surface which is suspended by said first drive wheel, said first rigid ring comprising an hour demarcation to represent the hour, said first inner annular surface of said first rigid ring with hour demarcation in contact with said first drive wheel so as to rotate said first rigid ring with hour demarcation at a different angular rate than said first drive wheel so that said first rigid ring rotates through one complete revolution once every twelve hours allowing the hour of the day to be interpreted using traditional clock interpretation means, said first rigid ring being held in contact with said first drive wheel by the force of gravity, wherein said first rigid ring rotates about a rigid ring axis, wherein said rigid ring axis is not coaxial with said axis of rotation;

(d) a second rigid ring comprising a second inner annular surface which is suspended by said second drive wheel, said second rigid ring comprising a minute demarcation to represent the minute of the hour, said second inner annular surface of said second rigid ring with minute demarcation in contact with said second drive wheel so as to rotate said second rigid ring with minute demarcation at a different angular rate than said second drive wheel so that said second rigid ring rotates through one complete revolution once every hour allowing the minute of the hour to be interpreted using traditional clock interpretation means, said second rigid ring being held in contact with said second drive wheel by the force of gravity, wherein said second rigid ring rotates substantially about said rigid ring axis;

(e) a first plurality of protrusions, wherein said first drive wheel comprises said first plurality of protrusions and said first plurality of protrusions are disposed about a perimeter of said first drive wheel, wherein each protrusion of said first plurality of protrusions is disposed within a first plane, wherein said first plane is perpendicular to said axis of rotation;

(f) a second plurality of protrusions, wherein said first drive wheel comprises said second plurality of protrusions and said second plurality of protrusions are disposed about said perimeter of said first drive wheel, wherein each protrusion of said second plurality of protrusions is disposed within a second plane, wherein said second plane is perpendicular to said axis of rotation, wherein said first plane is parallel to and offset from said second plane, wherein said first plurality of protrusions is circumferentially offset from said second plurality of protrusions such that as said first drive wheel rotates about said axis of rotation, individual protrusions from said first and second pluralities of protrusions alternately occupy a top dead center position;

(g) a first plurality of indentations, wherein said first rigid ring comprises said first plurality of indentations and said first plurality of indentations are disposed along said first inner annular surface, wherein each indentation of said first plurality of indentations is disposed within said first plane when said first rigid ring is suspended by said first drive wheel, wherein said first plurality of indentations are configured to mesh with said first plurality of protrusions as said first drive wheel rotates;

(h) a second plurality of indentations, wherein said first rigid ring comprises said second plurality of indentations and said second plurality of indentations are disposed along said first inner annular surface, wherein each indentation of said second plurality of indentations is disposed within said second plane when said first rigid ring is suspended by said first drive wheel, wherein said second plurality of indentations are configured to mesh with said second plurality of protrusions as said first drive wheel rotates;

(i) a third plurality of protrusions, wherein said second drive wheel comprises said third plurality of protrusions and said third plurality of protrusions are disposed about a perimeter of said second drive wheel, wherein each protrusion of said third plurality of protrusions is disposed within a third plane, wherein said third plane is perpendicular to said axis of rotation;

(j) a fourth plurality of protrusions, wherein said second drive wheel comprises said fourth plurality of protrusions and said fourth plurality of protrusions are disposed about said perimeter of said second drive wheel, wherein each protrusion of said fourth plurality of protrusions is disposed within a fourth plane, wherein said fourth plane is perpendicular to said axis of rotation, wherein said third plane is parallel to and offset from said fourth plane, wherein said third plurality of protrusions is circumferentially offset from said fourth plurality of protrusions such that as said second drive wheel rotates about said axis of rotation, individual protrusions from said third and fourth pluralities of protrusions alternately occupy a top dead center position;

(k) a third plurality of indentations, wherein said second rigid ring comprises said third plurality of indentations and said third plurality of indentations are disposed along said second inner annular surface, wherein each indentation of said third plurality of indentations is disposed within said third plane when said second rigid ring is suspended by said second drive wheel, wherein said third plurality of indentations are configured to mesh with said third plurality of protrusions as said second drive wheel rotates; and (l) a fourth plurality of indentations, wherein said second rigid ring comprises said fourth plurality of indentations and said fourth plurality of indentations are disposed along said second inner annular surface, wherein each indentation of said fourth plurality of indentations is disposed within said fourth plane when said second rigid ring is suspended by said second drive wheel, wherein said fourth plurality of indentations are configured to mesh with said fourth plurality of protrusions as said second drive wheel rotates.

2. A clock comprising:

(a) a clock movement comprising:

a case;

a battery compartment configured to interconnect to a battery;

a motor disposed within said case;

a gear train;

a mounting bushing, wherein said mounting bushing is an elongated tubular member, wherein said mounting bushing comprises a proximal end and a distal end, wherein said proximal end of said mounting bushing is fixed to said case;

an inner output shaft, wherein said inner output shaft is driven at a first angular rate by said motor;

an outer output shaft, wherein said outer output shaft is driven at a second angular rate by said motor, wherein said first angular rate is different than said second angular rate, wherein said inner shaft and said outer shaft are coaxial, wherein said inner shaft is at least partially disposed within said outer shaft, wherein said outer shaft and said mounting bushing are coaxial along an axis of rotation, wherein said outer shaft is at least partially disposed within said mounting bushing; and a support bushing, wherein said support bushing is fixed relative to said distal end of said mounting bushing, wherein a bearing portion of said support bushing is positioned distal to said mounting bushing, wherein said bearing portion of said support bushing includes an annular bearing surface surrounding a bearing portion of said outer output shaft, wherein no portion of said clock movement is disposed between said annular bearing surface and said bearing portion of said outer output shaft;

(b) first and second drive wheels, said first drive wheel is fixed to said outer output shaft and said second drive wheel is fixed to said inner output shaft;

(c) a first rigid ring comprising a first inner annular surface which is suspended by said first drive wheel, said first rigid ring comprising an hour demarcation to represent the hour, said first inner annular surface of said first rigid ring with hour demarcation in contact with said first drive wheel so as to rotate said first rigid ring with hour demarcation at a different angular rate than said first drive wheel so that said first rigid ring rotates through one complete revolution once every twelve hours allowing the hour of the day to be interpreted using traditional clock interpretation means, said first rigid ring being held in contact with said first drive wheel by the force of gravity, wherein said first rigid ring rotates about a rigid ring axis, wherein said rigid ring axis is not coaxial with said axis of rotation;

(d) a second rigid ring comprising a second inner annular surface which is suspended by said second drive wheel, said second rigid ring comprising a minute demarcation to represent the minute of the hour, said second inner annular surface of said second rigid ring with minute demarcation in contact with said second drive wheel so as to rotate said second rigid ring with minute demarcation at a different angular rate than said second drive wheel so that said second rigid ring rotates through one complete revolution once every hour allowing the minute of the hour to be interpreted using traditional clock interpretation means, said second rigid ring being held in contact with said second drive wheel by the force of gravity, wherein said second rigid ring rotates substantially about said rigid ring axis;

(e) a first plurality of indentations , wherein said first drive wheel comprises said first plurality of indentations and said first plurality of indentations are disposed about a perimeter of said first drive wheel, wherein each indentation of said first plurality of indentations is disposed within a first plane, wherein said first plane is perpendicular to said axis of rotation;

(f) a second plurality of indentations, wherein said first drive wheel comprises said second plurality of indentations and said second plurality of indentations are disposed about said perimeter of said first drive wheel, wherein each indentation of said second plurality of indentations is disposed within a second plane, wherein said second plane is perpendicular to said axis of rotation, wherein said first plane is parallel to offset from said second plane, wherein said first plurality of indentations is circumferentially offset from said second plurality of indentations such that as said first drive wheel rotates about said axis of rotation, individual indentations from said first and second pluralities of indentations alternately occupy a top dead center position;

(g) a first plurality of protrusions, wherein said first rigid ring comprises said first plurality of protrusions and said first plurality of protrusions are disposed along said first inner annular surface, wherein each protrusion of said first plurality of protrusions is disposed within said first plane when said first rigid ring is suspended by said first drive wheel, wherein said first plurality of protrusions are configured to mesh with said first plurality of indentations as said first drive wheel rotates;

(h) a second plurality of protrusions, wherein said first rigid ring comprises said second plurality of protrusions and said second plurality of protrusions are disposed along said first inner annular surface, wherein each protrusion of said second plurality of protrusions is disposed within said second plane when said first rigid ring is suspended by said first drive wheel, wherein said second plurality of protrusions are configured to mesh with said second plurality of indentations as said first drive wheel rotates;

(i) a third plurality of indentations, wherein said second drive wheel comprises said third plurality of indentations and said third plurality of indentations are disposed about a perimeter of said second drive wheel, wherein each indentation of said third plurality of indentations is disposed within a third plane, wherein said third plane is perpendicular to said axis of rotation;

(j) a fourth plurality of indentations, wherein said second drive wheel comprises said fourth plurality of indentations and said fourth plurality of indentations are disposed about said perimeter of said second drive wheel, wherein each indentation of said fourth plurality of indentations is disposed within a fourth plane, wherein said fourth plane is perpendicular to said axis of rotation, wherein said third plane is parallel to and offset from said fourth plane, wherein said third plurality of indentations is circumferentially offset from said fourth plurality of indentations such that as said second drive wheel rotates about said axis of rotation, individual indentations from said third and fourth pluralities of indentations alternately occupy a top dead center position;

(k) a third plurality of protrusions, wherein said second rigid ring comprises said third plurality of protrusions and said third plurality of protrusions are disposed along said second inner annular surface, wherein each protrusion of said third plurality of protrusions is disposed within said third plane when said second rigid ring is suspended by said second drive wheel, wherein said third plurality of protrusions are configured to mesh with said third plurality of indentations as said second drive wheel rotates; and (l) a fourth plurality of protrusions, wherein said second rigid ring comprises said fourth plurality of protrusions and said fourth plurality of protrusions are disposed along said second inner annular surface, wherein each protrusion of said fourth plurality of protrusions is disposed within said fourth plane when said second rigid ring is suspended by said second drive wheel, wherein said fourth plurality of protrusions are configured to mesh with said fourth plurality of indentations as said second drive wheel rotates.

3. A clock comprising:

a clock movement comprising:

a case;

a battery compartment configured to interconnect to a battery;

a motor disposed within said case;

a gear train;

a mounting bushing, wherein said mounting bushing is an elongated tubular member, wherein said mounting bushing comprises a proximal end and a distal end, wherein said proximal end of said mounting bushing is fixed to said case;

an inner output shaft, wherein said inner output shaft is driven at a first angular rate by said motor;

an outer output shaft, wherein said outer output shaft is driven at a second angular rate by said motor, wherein said first angular rate is different than said second angular rate, wherein said inner shaft and said outer shaft are coaxial, wherein said inner shaft is at least partially disposed within said outer shaft, wherein said outer shaft and said mounting bushing are coaxial along an axis of rotation, wherein said outer shaft is at least partially disposed within said mounting bushing; and a support bushing, wherein said support bushing is fixed relative to said distal end of said mounting bushing, wherein a bearing portion of said support bushing is positioned distal to said mounting bushing, wherein said bearing portion of said support bushing includes an annular bearing surface surrounding a bearing portion of said outer output shaft, wherein no portion of said clock movement is disposed between said annular bearing surface and said bearing portion of said outer output shaft;

first and second drive wheels, said first drive wheel is fixed to said outer output shaft and said second drive wheel is fixed to said inner output shaft, wherein said second drive wheel comprises a shaft portion disposed along said axis of rotation and distal to a distal end of said inner output shaft;

a cover, wherein said clock movement and said first and second drive wheels are disposed within said cover, wherein said cover comprises a first slot aligned with said first drive wheel, wherein said cover comprises a second slot aligned with said second drive wheel, wherein said cover comprises a hole, wherein said shaft portion of said second drive wheel is at least partially disposed within said hole, wherein said hole comprises a bearing portion in contact with said shaft portion, wherein said first and second drive wheels are disposed between said support bushing and said hole;

a first rigid ring comprising a first inner annular surface which is suspended by said first drive wheel, said first rigid ring comprising an hour demarcation to represent the hour, said first inner annular surface of said first rigid ring in contact with said first drive wheel so as to rotate said first rigid ring at a different angular rate than said first drive wheel so that said first rigid ring rotates through one complete revolution once every twelve hours allowing the hour of the day to be interpreted using traditional clock interpretation means, said first rigid ring being held in contact with said first drive wheel by the force of gravity, wherein a portion of said first rigid ring is disposed within said first slot, wherein said first rigid ring rotates about a rigid ring axis, wherein said rigid ring axis is not coaxial with said axis of rotation; and a second rigid ring comprising a second inner annular surface which is suspended by said second drive wheel, said second rigid ring comprising a minute demarcation to represent the minute of the hour, said second inner annular surface of said second rigid ring in contact with said second drive wheel so as to rotate said second rigid ring at a different angular rate than said second drive wheel so that said second rigid ring rotates through one complete revolution once every hour allowing the minute of the hour to be interpreted using traditional clock interpretation means, said second rigid ring being held in contact with said second drive wheel by the force of gravity, wherein a thickness of said second rigid ring is less than said width of said second slot, wherein a portion of said second rigid ring is disposed within said second slot, wherein said second rigid ring rotates substantially about said rigid ring axis.

4. A clock as in claim 3, further comprising:

(a) a first plurality of protrusions, wherein said first drive wheel comprises said first plurality of protrusions and said first plurality of protrusions are disposed about a perimeter of said first drive wheel, wherein each protrusion of said first plurality of protrusions is disposed within a first plane, wherein said first plane is perpendicular to said axis of rotation;

(b) a second plurality of protrusions, wherein said first drive wheel comprises said second plurality of protrusions and said second plurality of protrusions are disposed about said perimeter of said first drive wheel, wherein each protrusion of said second plurality of protrusions is disposed within a second plane, wherein said second plane is perpendicular to said axis of rotation, wherein said first plane is parallel to and offset from said second plane, wherein said first plurality of protrusions is circumferentially offset from said second plurality of protrusions such that as said first drive wheel rotates about said axis of rotation, individual protrusions from said first and second pluralities of protrusions alternately occupy a top dead center position;

(c) a first plurality of indentations, wherein said first rigid ring comprises said first plurality of indentations and said first plurality of indentations are disposed along said first inner annular surface, wherein each indentation of said first plurality of indentations is disposed within said first plane when said first rigid ring is suspended by said first drive wheel, wherein said first plurality of indentations are configured to mesh with said first plurality of protrusions as said first drive wheel rotates;

(d) a second plurality of indentations, wherein said first rigid ring comprises said second plurality of indentations and said second plurality of indentations are disposed along said first inner annular surface, wherein each indentation of said second plurality of indentations is disposed within said second plane when said first rigid ring is suspended by said first drive wheel, wherein said second plurality of indentations are configured to mesh with said second plurality of protrusions as said first drive wheel rotates;

(e) a third plurality of protrusions, wherein said second drive wheel comprises said third plurality of protrusions and said third plurality of protrusions are disposed about a perimeter of said second drive wheel, wherein each protrusion of said third plurality of protrusions is disposed within a third plane, wherein said third plane is perpendicular to said axis of rotation;

(f) a fourth plurality of protrusions, wherein said second drive wheel comprises said fourth plurality of protrusions and said fourth plurality of protrusions are disposed about said perimeter of said second drive wheel, wherein each protrusion of said fourth plurality of protrusions is disposed within a fourth plane, wherein said fourth plane is perpendicular to said axis of rotation, wherein said third plane is parallel to and offset from said fourth plane, wherein said third plurality of protrusions is circumferentially offset from said fourth plurality of protrusions such that as said second drive wheel rotates about said axis of rotation, individual protrusions from said third and fourth pluralities of protrusions alternately occupy a top dead center position;

(g) a third plurality of indentations, wherein said second rigid ring comprises said third plurality of indentations and said third plurality of indentations are disposed along said second inner annular surface, wherein each indentation of said third plurality of indentations is disposed within said third plane when said second rigid ring is suspended by said second drive wheel, wherein said third plurality of indentations are configured to mesh with said third plurality of protrusions as said second drive wheel rotates; and (h) a fourth plurality of indentations, wherein said second rigid ring comprises said fourth plurality of indentations and said fourth plurality of indentations are disposed along said second inner annular surface, wherein each indentation of said fourth plurality of indentations is disposed within said fourth plane when said second rigid ring is suspended by said second drive wheel, wherein said fourth plurality of indentations are configured to mesh with said fourth plurality of protrusions as said second drive wheel rotates.

5. A clock as in claim 4, wherein each protrusion of said first and second pluralities of protrusions is of a first radius, wherein each indentation of said first and second pluralities of indentations is of a second radius, wherein said second radius is larger than said first radius.

6. A clock as in claim 4, wherein each protrusion and indentation are configured such that any misalignment between a protrusion and indentation at a top dead center position that is greater than zero and less than a radius of said indentation will cause the protrusion to move toward alignment with the indentation due to the force of gravity.

7. A clock as in claim 4, wherein a diameter of said first inner annular surface is the same as a diameter of said second inner annular surface.

8. A clock as in claim 4, wherein said first drive wheel comprises first and second flanges disposed along a perimeter of said first drive wheel on opposing sides of said first drive wheel, wherein outer edges of said first and second flanges are a first distance apart from each other, wherein said second drive wheel comprises third and fourth flanges disposed along a perimeter of said second drive wheel on opposing sides of said second drive wheel, wherein outer edges of said third and fourth flanges are a second distance apart from each other, wherein a width of said first slot is less than said first distance, wherein a width of second slot is less than said second distance; and wherein a thickness of said first rigid ring is less than said width of said first slot, wherein a portion of said first rigid ring is disposed between said first and second flanges, wherein a thickness of said second rigid ring is less than said width of said second slot, wherein a portion of said second rigid ring is disposed between said third and fourth flanges.

9. A clock as in claim 3, further comprising:

(a) a first plurality of indentations , wherein said first drive wheel comprises said first plurality of indentations and said first plurality of indentations are disposed about a perimeter of said first drive wheel, wherein each indentation of said first plurality of indentations is disposed within a first plane, wherein said first plane is perpendicular to said axis of rotation;

(b) a second plurality of indentations, wherein said first drive wheel comprises said second plurality of indentations and said second plurality of indentations are disposed about said perimeter of said first drive wheel, wherein each indentation of said second plurality of indentations is disposed within a second plane, wherein said second plane is perpendicular to said axis of rotation, wherein said first plane is parallel to and offset from said second plane, wherein said first plurality of indentations is circumferentially offset from said second plurality of indentations such that as said first drive wheel rotates about said axis of rotation, individual indentations from said first and second pluralities of indentations alternately occupy a top dead center position;

(c) a first plurality of protrusions, wherein said first rigid ring comprises said first plurality of protrusions and said first plurality of protrusions are disposed along said first inner annular surface, wherein each protrusion of said first plurality of protrusions is disposed within said first plane when said first rigid ring is suspended by said first drive wheel, wherein said first plurality of protrusions are configured to mesh with said first plurality of indentations as said first drive wheel rotates;

(d) a second plurality of protrusions, wherein said first rigid ring comprises said second plurality of protrusions and said second plurality of protrusions are disposed along said first inner annular surface, wherein each protrusion of said second plurality of protrusions is disposed within said second plane when said first rigid ring is suspended by said first drive wheel, wherein said second plurality of protrusions are configured to mesh with said second plurality of indentations as said first drive wheel rotates;

(e) a third plurality of indentations, wherein said second drive wheel comprises said third plurality of indentations and said third plurality of indentations are disposed about a perimeter of said second drive wheel, wherein each indentation of said third plurality of indentations is disposed within a third plane, wherein said third plane is perpendicular to said axis of rotation;

(f) a fourth plurality of indentations, wherein said second drive wheel comprises said fourth plurality of indentations and said fourth plurality of indentations are disposed about said perimeter of said second drive wheel, wherein each indentation of said fourth plurality of indentations is disposed within a fourth plane, wherein said fourth plane is perpendicular to said axis of rotation, wherein said third plane is parallel to and offset from said fourth plane, wherein said third plurality of indentations is circumferentially offset from said fourth plurality of indentations such that as said second drive wheel rotates about said axis of rotation, individual indentations from said third and fourth pluralities of indentations alternately occupy a top dead center position;

(g) a third plurality of protrusions, wherein said second rigid ring comprises said third plurality of protrusions and said third plurality of protrusions are disposed along said second inner annular surface, wherein each protrusion of said third plurality of protrusions is disposed within said third plane when said second rigid ring is suspended by said second drive wheel, wherein said third plurality of protrusions are configured to mesh with said third plurality of indentations as said second drive wheel rotates; and (h) a fourth plurality of protrusions, wherein said second rigid ring comprises said fourth plurality of protrusions and said fourth plurality of protrusions are disposed along said second inner annular surface, wherein each protrusion of said fourth plurality of protrusions is disposed within said fourth plane when said second rigid ring is suspended by said second drive wheel, wherein said fourth plurality of protrusions are configured to mesh with said fourth plurality of indentations as said second drive wheel rotates.

10. A clock as in claim 9, wherein each protrusion of said first and second pluralities of protrusions is of a first radius, wherein each indentation of said first and second pluralities of indentations is of a second radius, wherein said second radius is larger than said first radius.

11. A clock as in claim 9, wherein each protrusion and indentation are configured such that any misalignment between a protrusion and indentation at a top dead center position that is greater than zero and less than a radius of said indentation will cause the protrusion to move toward alignment with the indentation due to the force of gravity.

12. A clock as in claim 9, wherein a diameter of said first inner annular surface is the same as a diameter of said second inner annular surface.

13. A clock as in claim 9, wherein said first drive wheel comprises first and second flanges disposed along a perimeter of said first drive wheel on opposing sides of said first drive wheel, wherein outer edges of said first and second flanges are a first distance apart from each other, wherein said second drive wheel comprises third and fourth flanges disposed along a perimeter of said second drive wheel on opposing sides of said second drive wheel, wherein outer edges of said third and fourth flanges are a second distance apart from each other, wherein a width of said first slot is less than said first distance, wherein a width of second slot is less than said second distance; and wherein a thickness of said first rigid ring is less than said width of said first slot, wherein a portion of said first rigid ring is disposed between said first and second flanges, wherein a thickness of said second rigid ring is less than said width of said second slot, wherein a portion of said second rigid ring is disposed between said third and fourth flanges.

14. A clock comprising:

(a) a clock movement comprising:

a case;

a battery compartment configured to interconnect to a battery;

a motor disposed within said case;

a gear train;

a mounting bushing, wherein said mounting bushing is an elongated tubular member, wherein said mounting bushing comprises a proximal end and a distal end, wherein said proximal end of said mounting bushing is fixed to said case;

an inner output shaft, wherein said inner output shaft is driven at a first angular rate by said motor;

an outer output shaft, wherein said outer output shaft is driven at a second angular rate by said motor, wherein said first angular rate is different than said second angular rate, wherein said inner shaft and said outer shaft are coaxial, wherein said inner shaft is at least partially disposed within said outer shaft, wherein said outer shaft and said mounting bushing are coaxial along an axis of rotation, wherein said outer shaft is at least partially disposed within said mounting bushing; and a support bushing, wherein said support bushing is fixed relative to said distal end of said mounting bushing, wherein a bearing portion of said support bushing is positioned distal to said mounting bushing, wherein said bearing portion of said support bushing includes an annular bearing surface surrounding a bearing portion of said outer output shaft, wherein no portion of said clock movement is disposed between said annular bearing surface and said bearing portion of said outer output shaft, wherein a load applied to said outer output shaft perpendicular to said axis of rotation at a distal end of said outer output shaft causes a reaction force on said outer output shaft from said annular bearing surface;

(b) first and second drive wheels, said first drive wheel is fixed to said outer output shaft and said second drive wheel is fixed to said inner output shaft, wherein said second drive wheel comprises a shaft portion disposed along said axis of rotation and distal to a distal end of said inner output shaft;

(c) a cover, wherein said clock movement and said first and second drive wheels are disposed within said cover, wherein said cover comprises a first slot aligned with said first drive wheel, wherein said cover comprises a second slot aligned with said second drive wheel, wherein said cover comprises a hole, wherein said shaft portion of said second drive wheel is at least partially disposed within said hole, wherein said hole comprises a bearing portion in contact with said shaft portion, wherein said first and second drive wheels are disposed between said support bushing and said hole;

(d) a first rigid ring comprising a first inner annular surface which is suspended by said first drive wheel, said first rigid ring comprising an hour demarcation to represent the hour, said first inner annular surface of said first rigid ring in contact with said first drive wheel so as to rotate said first rigid ring at a different angular rate than said first drive wheel so that said first rigid ring rotates through one complete revolution once every twelve hours allowing the hour of the day to be interpreted using traditional clock interpretation means, said first rigid ring being held in contact with said first drive wheel by the force of gravity, wherein a portion of said first rigid ring is disposed within said first slot, wherein said first rigid ring rotates about a rigid ring axis, wherein said rigid ring axis is not coaxial with said axis of rotation;

(e) a second rigid ring comprising a second inner annular surface which is suspended by said second drive wheel, said second rigid ring comprising a minute demarcation to represent the minute of the hour, said second inner annular surface of said second rigid ring in contact with said second drive wheel so as to rotate said second rigid ring at a different angular rate than said second drive wheel so that said second rigid ring rotates through one complete revolution once every hour allowing the minute of the hour to be interpreted using traditional clock interpretation means, said second rigid ring being held in contact with said second drive wheel by the force of gravity, wherein a thickness of said second rigid ring is less than said width of said second slot, wherein a portion of said second rigid ring is disposed within said second slot, wherein said second rigid ring rotates substantially about said rigid ring axis;

(f) a first plurality of protrusions, wherein said first drive wheel comprises said first plurality of protrusions and said first plurality of protrusions are disposed about a perimeter of said first drive wheel, wherein each protrusion of said first plurality of protrusions is disposed within a first plane, wherein said first plane is perpendicular to said axis of rotation;

(g) a second plurality of protrusions, wherein said first drive wheel comprises said second plurality of protrusions and said second plurality of protrusions are disposed about said perimeter of said first drive wheel, wherein each protrusion of said second plurality of protrusions is disposed within a second plane, wherein said second plane is perpendicular to said axis of rotation, wherein said first plane is parallel to and offset from said second plane, wherein said first plurality of protrusions is circumferentially offset from said second plurality of protrusions such that as said first drive wheel rotates about said axis of rotation, individual protrusions from said first and second pluralities of protrusions alternately occupy a top dead center position;

(h) a first plurality of indentations, wherein said first rigid ring comprises said first plurality of indentations and said first plurality of indentations are disposed along said first inner annular surface, wherein each indentation of said first plurality of indentations is disposed within said first plane when said first rigid ring is suspended by said first drive wheel, wherein said first plurality of indentations are configured to mesh with said first plurality of protrusions as said first drive wheel rotates;

(i) a second plurality of indentations, wherein said first rigid ring comprises said second plurality of indentations and said second plurality of indentations are disposed along said first inner annular surface, wherein each indentation of said second plurality of indentations is disposed within said second plane when said first rigid ring is suspended by said first drive wheel, wherein said second plurality of indentations are configured to mesh with said second plurality of protrusions as said first drive wheel rotates;

(j) a third plurality of protrusions, wherein said second drive wheel comprises said third plurality of protrusions and said third plurality of protrusions are disposed about a perimeter of said second drive wheel, wherein each protrusion of said third plurality of protrusions is disposed within a third plane, wherein said third plane is perpendicular to said axis of rotation;

(k) a fourth plurality of protrusions, wherein said second drive wheel comprises said fourth plurality of protrusions and said fourth plurality of protrusions are disposed about said perimeter of said second drive wheel, wherein each protrusion of said fourth plurality of protrusions is disposed within a fourth plane, wherein said fourth plane is perpendicular to said axis of rotation, wherein said third plane is parallel to and offset from said fourth plane, wherein said third plurality of protrusions is circumferentially offset from said fourth plurality of protrusions such that as said second drive wheel rotates about said axis of rotation, individual protrusions from said third and fourth pluralities of protrusions alternately occupy a top dead center position;

(l) a third plurality of indentations, wherein said second rigid ring comprises said third plurality of indentations and said third plurality of indentations are disposed along said second inner annular surface, wherein each indentation of said third plurality of indentations is disposed within said third plane when said second rigid ring is suspended by said second drive wheel, wherein said third plurality of indentations are configured to mesh with said third plurality of protrusions as said second drive wheel rotates; and (m) a fourth plurality of indentations, wherein said second rigid ring comprises said fourth plurality of indentations and said fourth plurality of indentations are disposed along said second inner annular surface, wherein each indentation of said fourth plurality of indentations is disposed within said fourth plane when said second rigid ring is suspended by said second drive wheel, wherein said fourth plurality of indentations are configured to mesh with said fourth plurality of protrusions as said second drive wheel rotates.

15. A clock as in claim 14, wherein each individual protrusion of said first and second pluralities of protrusions comprises a first draft angle in a plane that contains an entirety of said axis of rotation, wherein said first draft angle of said first plurality of protrusions faces said second plurality of protrusions, wherein said first draft angle of said second plurality of protrusions faces said first plurality of protrusions, wherein said first draft angle is disposed such that a portion of an indentation of said first and second pluralities of indentations in contact with said first draft angle will slide down to a bottom of said first draft angle and cause said first rigid ring to be in alignment with said first drive wheel; and wherein each individual protrusion of said third and fourth pluralities of protrusions comprises a second draft angle in a plane that contains an entirety of said axis of rotation, wherein said second draft angle of said third plurality of protrusions faces said fourth plurality of protrusions, wherein said second draft angle of said fourth plurality of protrusions faces said third plurality of protrusions, wherein said second draft angle is disposed such that a portion of an indentation of said third and fourth pluralities of indentations in contact with said second draft angle will slide down to a bottom of said second draft angle and cause said second rigid ring to be in alignment with said second drive wheel.

16. A clock comprising:

(a) a clock movement comprising:

a case;

a battery compartment configured to interconnect to a battery;

a motor disposed within said case;

a gear train;

a mounting bushing, wherein said mounting bushing is an elongated tubular member, wherein said mounting bushing comprises a proximal end and a distal end, wherein said proximal end of said mounting bushing is fixed to said case;

an inner output shaft, wherein said inner output shaft is driven at a first angular rate by said motor;

an outer output shaft, wherein said outer output shaft is driven at a second angular rate by said motor, wherein said first angular rate is different than said second angular rate, wherein said inner shaft and said outer shaft are coaxial, wherein said inner shaft is at least partially disposed within said outer shaft, wherein said outer shaft and said mounting bushing are coaxial along an axis of rotation, wherein said outer shaft is at least partially disposed within said mounting bushing; and a support bushing, wherein said support bushing is fixed relative to said distal end of said mounting bushing, wherein a bearing portion of said support bushing is positioned distal to said mounting bushing, wherein said bearing portion of said support bushing includes an annular bearing surface surrounding a bearing portion of said outer output shaft, wherein no portion of said clock movement is disposed between said annular bearing surface and said bearing portion of said outer output shaft, wherein a load applied to said outer output shaft perpendicular to said axis of rotation at a distal end of said outer output shaft causes a reaction force on said outer output shaft from said annular bearing surface;

(b) first and second drive wheels, said first drive wheel is fixed to said outer output shaft and said second drive wheel is fixed to said inner output shaft, wherein said second drive wheel comprises a shaft portion disposed along said axis of rotation and distal to a distal end of said inner output shaft;

(c) a cover, wherein said clock movement and said first and second drive wheels are disposed within said cover, wherein said cover comprises a first slot aligned with said first drive wheel, wherein said cover comprises a second slot aligned with said second drive wheel, wherein said cover comprises a hole, wherein said shaft portion of said second drive wheel is at least partially disposed within said hole, wherein said hole comprises a bearing portion in contact with said shaft portion, wherein said first and second drive wheels are disposed between said support bushing and said hole;

(d) a first rigid ring comprising a first inner annular surface which is suspended by said first drive wheel, said first rigid ring comprising an hour demarcation to represent the hour, said first inner annular surface of said first rigid ring in contact with said first drive wheel so as to rotate said first rigid ring at a different angular rate than said first drive wheel so that said first rigid ring rotates through one complete revolution once every twelve hours allowing the hour of the day to be interpreted using traditional clock interpretation means, said first rigid ring being held in contact with said first drive wheel by the force of gravity, wherein a portion of said first rigid ring is disposed within said first slot, wherein said first rigid ring rotates about a rigid ring axis, wherein said rigid ring axis is not coaxial with said axis of rotation;

(e) a second rigid ring comprising a second inner annular surface which is suspended by said second drive wheel, said second rigid ring comprising a minute demarcation to represent the minute of the hour, said second inner annular surface of said second rigid ring in contact with said second drive wheel so as to rotate said second rigid ring at a different angular rate than said second drive wheel so that said second rigid ring rotates through one complete revolution once every hour allowing the minute of the hour to be interpreted using traditional clock interpretation means, said second rigid ring being held in contact with said second drive wheel by the force of gravity, wherein a thickness of said second rigid ring is less than said width of said second slot, wherein a portion of said second rigid ring is disposed within said second slot, wherein said second rigid ring rotates substantially about said rigid ring axis;

(f) a first plurality of indentations , wherein said first drive wheel comprises said first plurality of indentations and said first plurality of indentations are disposed about a perimeter of said first drive wheel, wherein each indentation of said first plurality of indentations is disposed within a first plane, wherein said first plane is perpendicular to said axis of rotation;

(g) a second plurality of indentations, wherein said first drive wheel comprises said second plurality of indentations and said second plurality of indentations are disposed about said perimeter of said first drive wheel, wherein each indentation of said second plurality of indentations is disposed within a second plane, wherein said second plane is perpendicular to said axis of rotation, wherein said first plane is parallel to and offset from said second plane, wherein said first plurality of indentations is circumferentially offset from said second plurality of indentations such that as said first drive wheel rotates about said axis of rotation, individual indentations from said first and second pluralities of indentations alternately occupy a top dead center position;

(h) a first plurality of protrusions, wherein said first rigid ring comprises said first plurality of protrusions and said first plurality of protrusions are disposed along said first inner annular surface, wherein each protrusion of said first plurality of protrusions is disposed within said first plane when said first rigid ring is suspended by said first drive wheel, wherein said first plurality of protrusions are configured to mesh with said first plurality of indentations as said first drive wheel rotates;

(i) a second plurality of protrusions, wherein said first rigid ring comprises said second plurality of protrusions and said second plurality of protrusions are disposed along said first inner annular surface, wherein each protrusion of said second plurality of protrusions is disposed within said second plane when said first rigid ring is suspended by said first drive wheel, wherein said second plurality of protrusions are configured to mesh with said second plurality of indentations as said first drive wheel rotates;

(j) a third plurality of indentations, wherein said second drive wheel comprises said third plurality of indentations and said third plurality of indentations are disposed about a perimeter of said second drive wheel, wherein each indentation of said third plurality of indentations is disposed within a third plane, wherein said third plane is perpendicular to said axis of rotation;

(k) a fourth plurality of indentations, wherein said second drive wheel comprises said fourth plurality of indentations and said fourth plurality of indentations are disposed about said perimeter of said second drive wheel, wherein each indentation of said fourth plurality of indentations is disposed within a fourth plane, wherein said fourth plane is perpendicular to said axis of rotation, wherein said third plane is parallel to and offset from said fourth plane, wherein said third plurality of indentations is circumferentially offset from said fourth plurality of indentations such that as said second drive wheel rotates about said axis of rotation, individual indentations from said third and fourth pluralities of indentations alternately occupy a top dead center position;

(l) a third plurality of protrusions, wherein said second rigid ring comprises said third plurality of protrusions and said third plurality of protrusions are disposed along said second nner annular surface, wherein each protrusion of said third plurality of protrusions is disposed within said third plane when said second rigid ring is suspended by said second drive wheel, wherein said third plurality of protrusions are configured to mesh with said third plurality of indentations as said second drive wheel rotates; and (m) a fourth plurality of protrusions, wherein said second rigid ring comprises said fourth plurality of protrusions and said fourth plurality of protrusions are disposed along said second inner annular surface, wherein each protrusion of said fourth plurality of protrusions is disposed within said fourth plane when said second rigid ring is suspended by said second drive wheel, wherein said fourth plurality of protrusions are configured to mesh with said fourth plurality of indentations as said second drive wheel rotates.

17. A clock as in claim 16, wherein each individual protrusion of said first and second pluralities of protrusions comprises a first draft angle in a plane that contains an entirety of said axis of rotation, wherein said first draft angle of said first plurality of protrusions faces said second plurality of protrusions, wherein said first draft angle of said second plurality of protrusions faces said first plurality of protrusions, wherein said first draft angle is disposed such that a portion of an indentation of said first and second pluralities of indentations in contact with said first draft angle will cause said first rigid ring to slide along said first draft angle to a position in alignment with said first drive wheel; and wherein each individual protrusion of said third and fourth pluralities of protrusions comprises a second draft angle in a plane that contains an entirety of said axis of rotation, wherein said second draft angle of said third plurality of protrusions faces said fourth plurality of protrusions, wherein said second draft angle of said fourth plurality of protrusions faces said third plurality of protrusions, wherein said second draft angle is disposed such that a portion of an indentation of said third and fourth pluralities of indentations in contact with said second draft angle will cause said second rigid ring to slide along said second draft angle to a position in alignment with said second drive wheel.

* * * * *